US006102221A

United States Patent [19]

Habisohn

[11] Patent Number: 6,102,221

[45] Date of Patent: Aug. 15, 2000

[54] METHOD FOR DAMPING LOAD OSCILLATIONS ON A CRANE

[76] Inventor: Chris Xavier Habisohn, 1505 Falcon La., Hoffman Estates, Ill. 60192

[21] Appl. No.: 09/343,105

[22] Filed: Jun. 29, 1999

Related U.S. Application Data

[63] Continuation of application No. 08/591,856, Jan. 26, 1996, Pat. No. 5,960,969.

[51] Int. Cl.[7] ..... B66C 13/06

[52] U.S. Cl. ..... 212/270; 212/275; 340/685

[58] Field of Search ..... 212/275, 270; 340/685

[56] References Cited

U.S. PATENT DOCUMENTS

| | | | |
|---|---|---|---|
| 2,801,351 | 4/1957 | Calvert et al. | 307/149 |
| 3,010,035 | 11/1961 | Calvert et al. | 307/152 |
| 3,517,830 | 6/1970 | Virkkala | 212/132 |
| 3,921,818 | 11/1975 | Yamagishi | 212/132 |
| 4,512,711 | 4/1985 | Ling et al. | 414/786 |
| 4,603,783 | 8/1986 | Tax et al. | 212/132 |
| 4,717,029 | 1/1988 | Yasunobu et al. | 212/132 |
| 4,756,432 | 7/1988 | Kawashima et al. | 212/132 |
| 4,916,635 | 4/1990 | Singer et al. | 364/513 |
| 4,945,294 | 7/1990 | Anderson, Jr. | 318/119 |
| 4,997,095 | 3/1991 | Jones et al. | 212/147 |
| 5,127,533 | 7/1992 | Virkkunen | 212/147 |
| 5,219,420 | 6/1993 | Kiiski et al. | 212/147 |
| 5,296,791 | 3/1994 | Hipp | 318/563 |
| 5,373,460 | 12/1994 | Marks, II | 364/724.01 |
| 5,490,601 | 2/1996 | Heissat et al. | 212/275 |
| 5,526,946 | 6/1996 | Overton | 212/275 |
| 5,529,193 | 6/1996 | Hytonen | 212/275 |
| 5,610,848 | 3/1997 | Fowell | 364/724.07 |
| 5,638,267 | 6/1997 | Singhose et al. | 364/148 |
| 5,713,478 | 2/1998 | Habisohn | 212/275 |
| 5,819,963 | 10/1998 | Habisohn | 212/275 |
| 5,897,006 | 4/1999 | Habisohn | 212/270 |
| 5,960,969 | 10/1999 | Habisohn | 212/275 |

FOREIGN PATENT DOCUMENTS 0 433 375 B1 10/1996 European Pat. Off. .

OTHER PUBLICATIONS

Aspinwall, D. M., "Acceleration Profiles for Minimizing Residual Response", Journal of Dynamic Systems, Measurement and Control, Mar. 1980, vol. 102/3, 4 pages.

Auernig et al., "Time Optimal Control of Overhead Cranes with Hoisting of the Load", Automatica, vol. 23, No. 4, pp. 437–447, 1987.

Butler et al., "Model Reference Adaptive Control of Gantry Crane Scale Model", IEEE Jan. 1991, pp. 57–62.

Cook, Gerald "Control of Flexible Structures Via Posicast", Dept. of Electrical & Computer Engineering, George Mason University, pp. 31–35 (prior art).

Cook, Gerald "An Application of Half–Cycle Posicast" IEEE Transactions on Automatic Control, Jul. 1966, pp. 556–559.

(List continued on next page.)

*Primary Examiner*—Thomas J. Brahan

*Attorney, Agent, or Firm*—Marshall, O'Toole, Gerstein, Murray & Borun

[57] ABSTRACT

A method and device for damping the oscillation of a load suspended from a rope on a crane is presented. A digital filter accepts an arbitrary velocity input signal and produces a velocity signal output similar to the input and that runs a bridge or trolley drive while damping the load's swing. One version of the damping filter may be implemented by programming a microprocessor to output a simple average of the input signal and the input signal delayed by one-half period of the pendulum motion of the load. A second version of the invention averages the input signals over the period of the pendulum motion to producing a damping signal. A third version of the invention averages the input signal with two delayed versions of the input signal. The third version will produce motion that will dampen load swing for a large range of rope lengths. Furthermore, if an additional signal representing rope length is taken, all three versions can be adapted to dampen swing for a full range of rope lengths.

24 Claims, 14 Drawing Sheets

OTHER PUBLICATIONS

Cook, Gerald "Posicast Versus Conventional Types of Compensation in a Control System", B.S., Virginia Polytechnic Institute, 1961, 51 pages.
Crain et al., "Evaluation of Input Shaping of Configuration Dependent Systems", vol. 1, ASME Jul. 1996, pp. 315–318.
Dodds et al., "A signed switching time bang–bang attitude control law for fine pointing of flexible spacecraft", Int. J. Control, 1984, vol. 40, No. 4, pp. 795–811.
Dodds et al., "A Dynamics Parameter Invariant Attitude Control System for Flexible Spacecraft", International Conference of Dynamics of Flexible Structures in Space, May 15–18, 1990, pp. 157–181.
Erickson, Bert K., "Input Attenuation Functions Improve Servomechanism Performance", IEEE Transactions on Industrial Electronics and Control Instrumentation, vol. IECI–18, No. 4, Nov. 1971, pp. 144–156.
Fairfield, R. L., "Designing a Deadbeat Compensating Network", Control Engineering, Aug. 1966, pp. 75–77.
Farrenkopf, "Optimal Open–Loop Maneuver Profiles for Flexible Spacecraft", J. Guidance and Control, vol. 2, No. 6, Article No. 78–1280R, Nov.–Dec. 1979, pp. 491–498.
Ford et al., "The Application of Short–Time Memory Devices to Compensator Design", AIEE Winter General Meeting, Jan. 18–22, 1954, pp. 88–93.
Gimpel, et al., "Signal Component Control", AIEE Summer General Meeting Jun. 23–27, 1952, pp. 339–343.
Gorbatenko, George G., "Posicast Control by Delayed Gain", Control Engineering, Feb. 1965, 4 pages.
Gupta, Narendra K. "Frequency–Shaped Cost Functionals: Extension of Linear–Quadratic–Gaussian Design Methods", American Institute of Aeronautics and Astronautics, Inc., 1980, 7 pages.
Horng et al., "Digital Posicast Technique to Second Order Control Systems", Journal of the Chinese Society of Mechanical Engineers, vol. 6, No. 2, pp. 103–106, 1985.
Hyde et al., "Contact Transition Control: An Experimental Study", 1993 IEEE, pp. 363–368.
Hyde et al., "Inhibiting Multiple Mode Vibration in Controlled Flexible Systems", Proceedings of the 1991 American Control Conference, pp. 2449–2454.
Hyde et al., "Controlling Contact Transition", 1994 IEEE, Feb. 1994, pp. 25–30.
Hyde et al., "Using Input Command Pre–Shaping to Suppress Multiple Mode Vibration", Proceedings of the 1991 IEEE International Conference on Robotics and Automation, Apr. 1991, pp. 2604–2609.
Jones et al., "Control Input Shaping for Coordinate Measuring Machines", American Control Conference 1994, pp. 2899–2903.
Jones et al., "Swing Damped Movement of Suspended Objects", Sandia Report, Sep. 1990, pp. i–ii and 1–34.
Jones et al., "Oscillation Damped Movement of Suspended Objects", 1988 IEEE Bulletin, pp. 956–962.
Juang et al., "Closed–Form Solutions for Feedback Control with Terminal Constraints", J. Guidance, American Institute of Aeronautics and Astronautics, Inc. vol. 8, No. 1, Jan.–Feb. 1985, pp. 39–41.
Kallmann, Heinz E., "Transversal Filters", Proceedings of the I.R.E. Jul. 1940, pp. 302–310.
Kim et al., "Control of Induction Motors for Both high Dynamic Performance and High Power Efficiency", IEEE Transactions On Industrial Electronics, vol. 39, No. 4, Aug. 1992, pp. 323–333.
Kreisselmeier et al., "Application of Vector Performance Optimization to a Robust Control Loop Design for a Fighter Aircraft", 1980, pp. 1–69.
Kress et al., "Experimental Implementation of a Robust Damped–Oscillation Control Algorithm On a Full–Sized, Two–Degree–Of–Freedom, AC Induction Motor–Driven Crane", 3 pages, published Aug. 1994.
Kress et al., "Experimental Implementation of a Robust Damped–Oscillation Control Algorithm On a Full–Sized, Two–Degree–Of–Freedom, AC Induction Motor–Driven Crane", 8 pages, published Aug. 1994.
Magee et al., "The Application of Input Shaping To A System With Varying Parameters", Japan/USA Symposium on Flexible Automation–vol. 1, ASME 1992, pp. 519–526.
Magee et al., "Eliminating Multiple Modes of Vibration in a Flexible Manipulator", 1993 IEEE, pp. 474–479.
Magee et al., "Filtering Schilling Manipulator Commands to Prevent Flexible Structure Vibration", Proceedings of the American Control Conference, Jun. 1994, pp. 2538–2542.
Magee et al., "Implementing Modified Command Filtering to Eliminate Multiple Modes of Vibration", Proceedings of the American Control Conference, Jun. 1993, pp. 2700–2704.
Marttinen et al., "Modelling and analysis of a trolley crane", Proceedings of the Intern. AMSE Conference "Modelling & Simulation", Pomona, California, Dec. 16–18, 1987, vol. 3, p 15–26.
Marttinen, Arto "Pole–Placement Control of a Pilot Gantry", 3 pages, 1989.
Meckl et al., "Feedforward Control Techniques to Achieve Fast Settling Time in Robots", pp. 1913–1918, 1986.
Meckl et al., "Minimizing Residual Vibration for Point–to–Point Motion", Transactions of the ASME, vol. 107, Oct. 1985, pp. 378–382.
Meckl et al., "Reducing Residual Vibration In Systems With Time–Varying Resonances", 1987 IEEE, pp. 1690–1695.
Mee, D. H., "A Feedback Implementation of Posicast Control Using Sampling Circuits", Proceedings of the IREE, Jan./Feb. 1974, pp. 11–15.
Moustafa et al., "Nonlinear Modeling and Control of Overhead Crane Load Sway", Journal of Dynamic Systems, Measurement and Control, Transactions of the ASME, vol. 110, Sep. 1988, pp. 266–271.
Murphy et al., "Digital Shaping Filters for Reducing Machine Vibration", 1992 IEEE, 5 pages.
Noakes et al., "An Application Of Oscillation Damped Motion For Suspended Payloads to the Advanced Integrated Maintenance System", pp. 63–67, published Aug. 1994.
Noakes et al., "Generalized inputs for damped–vibration control of suspended payloads", Robotics and Autonomous Systems 10, 1992, pp. 199–205.
Noakes et al., "Implementation of Damped–Oscillation Crane Control for Existing AC Induction Motor–Driven Cranes", pp. 479–485, published Aug. 1994.
Noakes et al., "Shaping Inputs To Reduce Vibration For Suspended Payloads", pp. 141–150, published Aug. 1994.
Ohnishi et al., "Automatic Control Of An Overhead Crane", IFAC Control Science and Technology, 1981, pp. 1885–1890.
Petterson et al., "Parameter–Scheduled Trajectory Planning for Suppression of Coupled Horizontal and Vertical Vibrations in a Flexible Rod", pp. 916–920, 1990.
Ridout, A. J. "New Feedback Control System for Overhead Cranes", Electric Energy Conference, Oct. 1987, pp. 135–140.

Sakawa et al., "Optimal Control of Container Cranes", Automatics, vol. 18, No. 3, pp. 257–266, 1982.
Sato et al., "Modelling and control of a flexible rotary crane", Int. J. Control, 1988, vol. 48, No. 5, pp. 2085–2105.
Salminen, Riku "Towards Industrial Crane Computer Control", Helsinki University of Technology, Chapters 7 through 10, pp. 33–74, May 1991.
Sehitoglu et al., "Design of a Trajectory Controller for Industrial Robots Using Bang–Bang and Cycloidal Motion Profiles", pp. 169–175, 1986.
Singer et al., "Design and Comparison of Command Shaping Methods for Controlling Residual Vibration", 1989 IEEE, pp. 888–893.
Singer et al., "An Extension of Command Shaping Methods for Controlling Residual Vibration Using Frequency Sampling", Proceedings of the 1992 IEEE International Conference on Robotics and Automation, pp. 800–805.
Singer et al., "An Input Shaping Controller Enabling Cranes to Move Without Sway", pp. 225–231, May 1997.
Singer et al., "Preshaping Command Inputs to Reduce System Vibration", Transactions of the ASME, Journal of Dynamic Systems, Measurement, and Control, vol. 112, Mar. 1990, 6 pages.
Singer et al., "Preshaping Command Inputs to Reduce System Vibration", Massachusetts Institute of Technology, Jan. 1988, 24 pages.
Singer, Neil C. "Residual Vibration Reduction in Computer Controlled Machines", Technical Report 1030, Feb. 1989, pp. 1–227.
Singer et al., "Using Acausal Shaping Techniques to Reduce Robot Vibration", 1988 IEEE, pp. 1434–1439.
Singh et al., "Robust Time–Optimal Control: Frequency Domain Approach", Journal of Guidance, Control, and Dynamics, vol. 17, No. 2, Mar.–Apr. 1994, pp. 346–353.
Singhose, W. "Shaping Inputs to Reduce Vibration: A Vector Diagram Approach", Massachusetts Institute of Technology, Mar. 1990, pp. 3–53.
Singhose et al., "Shaping Inputs to Reduce Vibration: a Vector Diagram Approach", 1990 IEEE, pp. 922–927.
Singhose et al., "Input Shaping for Vibration Reduction With Specified Insensitivity to Modeling Errors", Japan/USA Symposium on Flexible Automation, vol. 1, ASME Jul. 1996, pp. 307–313.
Singhose et al., "Extra–Insensitive Input Shapers for Controlling Flexible Spacecraft", Journal of Guidance, Control, and Dynamics, vol. 19, No. 2, Mar.–Apr. 1996, pp. 385–391.
Singhose et al., "Effects of Input Shaping on Two–Dimensional Trajectory Following", IEEE Transactions on Robotics and Automation, vol. 12, No. 6, Dec. 1996, pp. 881–887.
Singhose et al., "Input Shapers for Improving the Throughput of Torque–Limited Systems", 1994 IEEE, pp. 1517–1522.
Singhose et al., "Design and Implementation of Time–Optimal Negative Input Shapers", DSC–vol. 55–1, Dynamic Systems and Control: vol. 1, ASME 1994, pp. 151–157.
Smith, Otto J. M., "Posicast Control of Damped Oscillatory Systems", Proceedings.
Smith, Otto J. M., "Feedback Control Systems", McGraw–Hill Book Company, Inc., 1958, pp. 329–345.
So et al., "A Modified Posicast Method of Control With Applications to Higher–Order Systems", Nov. 1960, pp. 320–326.
Starr, G. P., "Swing–Free Transport of Suspended Objects With a Path–Controlled Robot Manipulator", Journal of Dynamic Systems, Measurement and Control, Technical Briefs, 1985, 5 pages.
Swigert, C. J. "Shaped Torque Techniques", J. Guidance and Control, vol. 3, Sep.–Oct. 1980, pp. 460–467.
Sze et al., "Short–Time Memory Devices in Closed–Loop System—Steady–State Response", AIEE Fall General Meeting, Oct. 3–7, 1955, pp. 340–344.
Tuttle et al., "A Zero–placement Technique for Designing Shaped Inputs to Suppress Multiple–mode Vibration", Proceedings of the American Control Conference, Jun. 1994, pp. 2533–2537.
Virkkunen et al., "Computer Control Of A Loading Bridge", IEE International Conference, Apr. 1988, 6 pages.
Wang et al., "Open–Loop Control Of A Flexible Robot Manipulator", International Journal of Robotics and Automation, vol. 1, No. 2, 1986, pp. 54–57.
Yoon et al., "Development of Anti–Swing Control Algorithm for the Overhead Crane", Remote Technology Section, Spent Fuel Management Division, Korea Atomic Energy Research Institute, 14 pages, published Aug. 1994.
Yu et al., "Fault Diagnosis for a Gas–Fired Furnace Using Bilinear Observer Method", Proceedings of the American Control Conference, Jun. 1995, pp. 1127–1131.
Convolve, Inc. document entitled "New Control Strategy Eliminates Residual Vibrations", Oct. 1994, 2 pages.

METHOD FOR DAMPING LOAD OSCILLATIONS ON A CRANE

This is a Continuation of U.S. application Ser. No. 08/591,856 filed Jan. 26, 1996, now U.S. Pat. No. 5,960,969.

FIELD OF THE INVENTION

The present invention relates generally to a method and device for dampening oscillations of a load supported by a crane. More particularly, the invention relates to an open loop method for shaping the speed signal controlling the horizontal motion of a crane to dampen load oscillations.

THE STATE OF THE ART

Suspension cranes are used to support and transport loads suspended by a variable length rope hoist. The hoist is attached to a carriage which is traversed along a track. It is desirable to reduce oscillation of the load when it is moved by the crane. Variable speed motor drives on cranes allow very fine and smooth control of the carriage and the load on their traversing run. A traversing run is the travel of the carriage from a beginning rest position to an end rest position. Present methods of damping load oscillations have focused on generating speed signals that, when input into the motor drives controlling the crane carriage's horizontal motion, will produce minimal swing.

Certain known damping methods use a closed loop with feedback control from the angular deviation of the hoisting rope from rest. In these closed loop methods, the magnitude of the deviation of the rope suspending the load from vertical is fed back into a damping controller. The damping controller adjusts the speed signal sent to the motor controlling the horizontal motion of the crane in a fashion that will dampen the load swing.

Other known damping methods include open loop controls which do not use angular deviation feedback from the rope. However, open loop methods are limited to insuring that the load will not be oscillating or have minimal swing after a transition from one constant speed to another, assuming the load was initially not swinging. This presumes that no other forces, except gravity and the carriage motor force are acting on the load. In particular, if the load is not swinging at the beginning of a carriage run then it will not be swinging at the end of the run.

Most open loop methods rely on one of two methods for damping swing. The first method may be termed as an "open loop control with a transfer function." The second method may be termed as a "control with a pattern."

Normally, control with a transfer function uses feedback. However, controlling with a transfer function may be implemented in an open loop by using virtual feedback. A signal representing the angular deviation of the load is calculated as a function of previous signals used to control the crane. The load calculation is used as a feedback signal to construct a damping signal. This is similar to how real feedback signals are used in the closed loop methods already described.

Controlling load oscillation with a pattern entails applying a predetermined pattern of acceleration to the crane in response to speed commands. The patterns of acceleration are chosen to dampen load swing for a fixed length of hoisting rope. Two versions of this control method are presently in use. One may be termed the "period-averaged" version and the other may be termed the "fast-response" version.

In the period-averaged version, a change in speed causes the controller to compute an acceleration rate that will implement the requested speed change in one period of the load's pendulum motion. The computed acceleration is then applied to the motor for one full period to dampen load swing.

In the fast-response version, the acceleration rate is fixed. A request for a change in speed results in computing an acceleration time that will provide for half the requested speed change at the fixed acceleration rate. The fixed acceleration rate is applied to the motor for the determined acceleration time and then followed by an equal interval of acceleration one-half period later. Accelerations applied in this fashion also dampen load swing.

For applications having a varying rope length, implementing the fast-response pattern or the period-averaged pattern methods usually require the use of a rope length sensor to determine the length of the hoisting rope to compute the load's pendulum motion period.

Generally most methods involving these patterns do not allow the input speed command to be changed at arbitrary times. Full compensation must occur for a change in speed command before additional commands may be recognized. In the period-averaged version, once an acceleration has begun, a change in the input speed command will not be recognized for one full period.

A generalization of the fast-response version that responds to changes in input speed commands at arbitrary times has been proposed by Kiiski and Mailisto, U.S. Pat. No. 5,219,420. In this method, two acceleration sequences are calculated upon recognition of a change in the input speed signal. One cancels the swing any previous motion has caused, and the other accelerates the load to the new speed without any swing. This method requires a large number of calculations at the instant of a speed change and relatively few calculations when the speed input is constant. Thus, there is a fairly demanding requirement on the computer needed to implement it, increasing cost. Furthermore, the complexity makes it difficult for implementation by a microprocessor associated with the variable frequency drive. This method also requires an input signal and corresponding rope length sensor, further increasing cost.

A common feature to all load oscillation damping systems is that changes in speed commands cannot be instantly compensated. A certain settling time must elapse before speed changes are entirely compensated. The controller must spread out the accelerations over time to dampen oscillations. Presently, the Kiiski and Mailisto damping method produces the fastest response to input command changes without causing the carriage to reverse during operation. However, by optimizing speed this method is very sensitive to rope length. If the actual rope length rope varies by even 10% from the length indicated by the rope length signal, the load oscillation becomes noticeable. Hence, this method requires a rope length sensor to monitor the hoisting rope length. Further complications arise from different loads on the crane's hook having different centers of mass, hence the length from the suspension point to the load's center of mass is dependent on the load type. One reason for different loads having different centers of mass is due to a difference in the length of the rope, or sling used to secure the load to the hook. In addition to sling or rope length there are other reasons for different loads having different centers of mass such as their orientation. The change in sling or rope length will not be indicated by any standard rope length sensor, hence differing amounts of oscillation for different sling lengths can only be corrected by tuning the rope length signal to a new sling length every time a new load type is placed on the hook or by ignoring the oscillations altogether.

SUMMARY OF THE INVENTION

Therefore, it is a primary object of the present invention to provide an open loop method for damping load oscillations by using a computer to shape the speed signals sent to the variable speed drive of the carriage motor.

Another primary object of the invention is to provide a general method for controlling a crane with a pattern to cause load oscillations to be damped.

Another primary object of the invention is to provide an open loop method for damping load oscillations that responds to changes in input speed commands at arbitrary times.

Another primary object of the invention is to provide an open loop method for damping load oscillations that responds to a rope length signal.

Another primary object of the invention is to provide an open loop method for damping load oscillations over a broad range of rope lengths without the need for a rope length sensor.

Another primary object of the invention is to provide an open loop method for damping load oscillations over a broad range of rope lengths, eliminating the need to adjust the rope length signal for different sling lengths.

These and other objectives are accomplished by the present invention which is a method of damping load oscillations during a traversing run of a load suspended by a hoisting rope from a movable carriage on a track. The carriage is powered by a motor controlled by a motor drive. A motion reference signal, representative of a desired motion of the carriage, is generated. The motion reference signal is recorded at different times. A damping signal, r(t), is formed based on a linear combination of the recorded motion reference signals. The damping signal, r(t), is coupled to the motor drive to control carriage motion and the damping signal causes load oscillations to be damped.

The motion reference signal may be a speed reference signal s(t). A pattern characterizing the type of desired damping is applied to the motion reference signal to produce the damping signal. The hoisting rope length may be sensed and used to affect the rate at which the motion reference signals are recorded. The memory may thus be a shifting array with a clocking input which controls the rate at which the memory stores the motion reference signals.

Another embodiment of the present invention is a load oscillation dampener for dampening oscillations of a load suspended by a hoisting rope from a movable carriage mounted on a support. The movable carriage is powered by a motor controlled by a motor drive. The dampener has a motion signal generator which produces a motion reference signal related to a desired motion of the carriage. A memory stores the motion reference signal at different times. A controller is coupled to the memory and the motor drive and is operative to generate a damping signal by applying a damping pattern to the stored motion reference signal. The controller sends the damping signal to the motor drive and load oscillations are damped by the motor drive in response to the damping signal.

The novel features which are believed to be characteristic of the invention, together with further objectives and advantages thereof will be better understood from the following description considered in connection with the accompanying drawings.

BRIEF DESCRIPTION OF THE DRAWINGS

The present invention may be better understood with reference to the detailed description in conjunction with the following Figures where the same reference numbers are employed to indicate corresponding identical elements.

DESCRIPTION OF THE PREFERRED EMBODIMENTS

The description of the preferred embodiments is divided into four sections: Section 1. The Key Steps Of The Present Invention; Section 2. Embodiments Based On A Preset Rope Length; Section 3. Insensitive Patterns; and Section 4. Adapting The Method To Respond To A Varying Rope Length.

Section 1, The Key Steps Of The Present Invention, describes the key steps that characterize the method of the present invention. Section 2, Embodiments Based On A Preset Rope Length, describes three embodiments of the present invention for applications where rope length information is conveyed by preset constants representing a preset rope length. Section 3, Insensitive Patterns, defines the notion of controlling a crane with a pattern. There may be many additional patterns, to be referred to as "insensitive patterns" that dampen swing over a larger range of rope lengths other than the fast-response or period-averaged patterns. Section 4, Adapting The Method To Respond To A Varying Rope Length Signal, demonstrates adapting the embodiments described in the other sections to respond to a varying rope length signal produced by a rope length sensor to provide damping over the full range of hoisting rope lengths.

Section 1: The Key Steps Of The Invention

Figure 1:
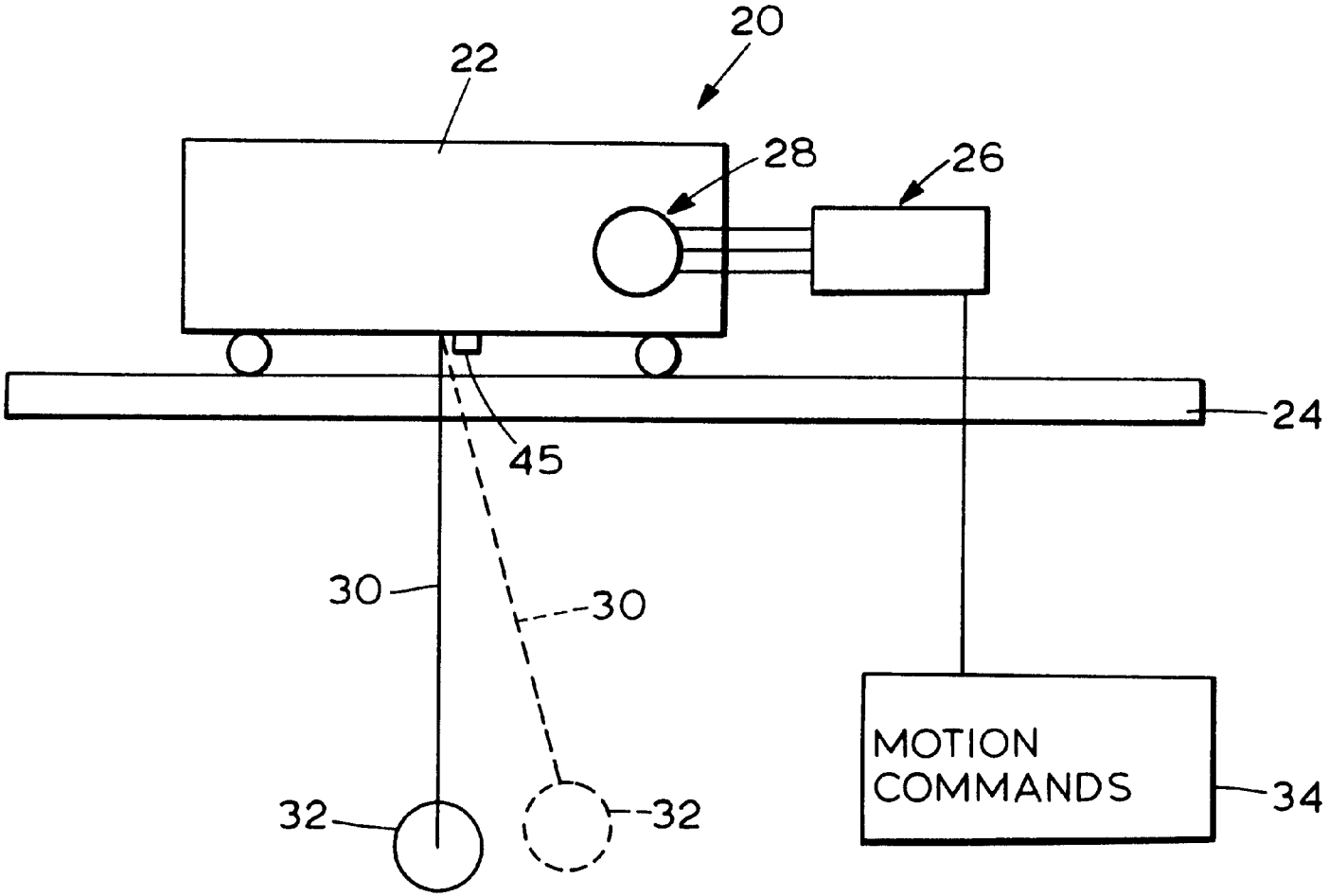
FIG. 1 is a block diagram of a crane carriage driven by a motor controller embodying the principles of the invention.

FIG. 1 is a block diagram of a crane system 20 which includes a crane bridge or trolley carriage 22 driven horizontally from one location to another along a track 24. The traversing movement of the carriage 22 is controlled by a motor controller 26. The motor controller 26 drives a motor 28 and simultaneously prevents swinging of a hoisting rope 30 and a load 32 connected to the hoisting rope 30. The motor controller 26 is a variable frequency drive manufactured by Power Electronics in the preferred embodiment. The motor 28 is a three phase squirrel cage induction motor. Of course, other types of motors and motor controllers such as D.C. motors and D.C. controllers with tachometers may be used for motor controller 26 and motor 28. A motion selector 34 is used by the crane operator to control the desired motion of the carriage 22 along the track 24. Typically, an operator inputs a desired motion such as speed to the motion selector 34 through a push button arrangement. However more complex variable speed selection arrangements may be used.

Figure 2:
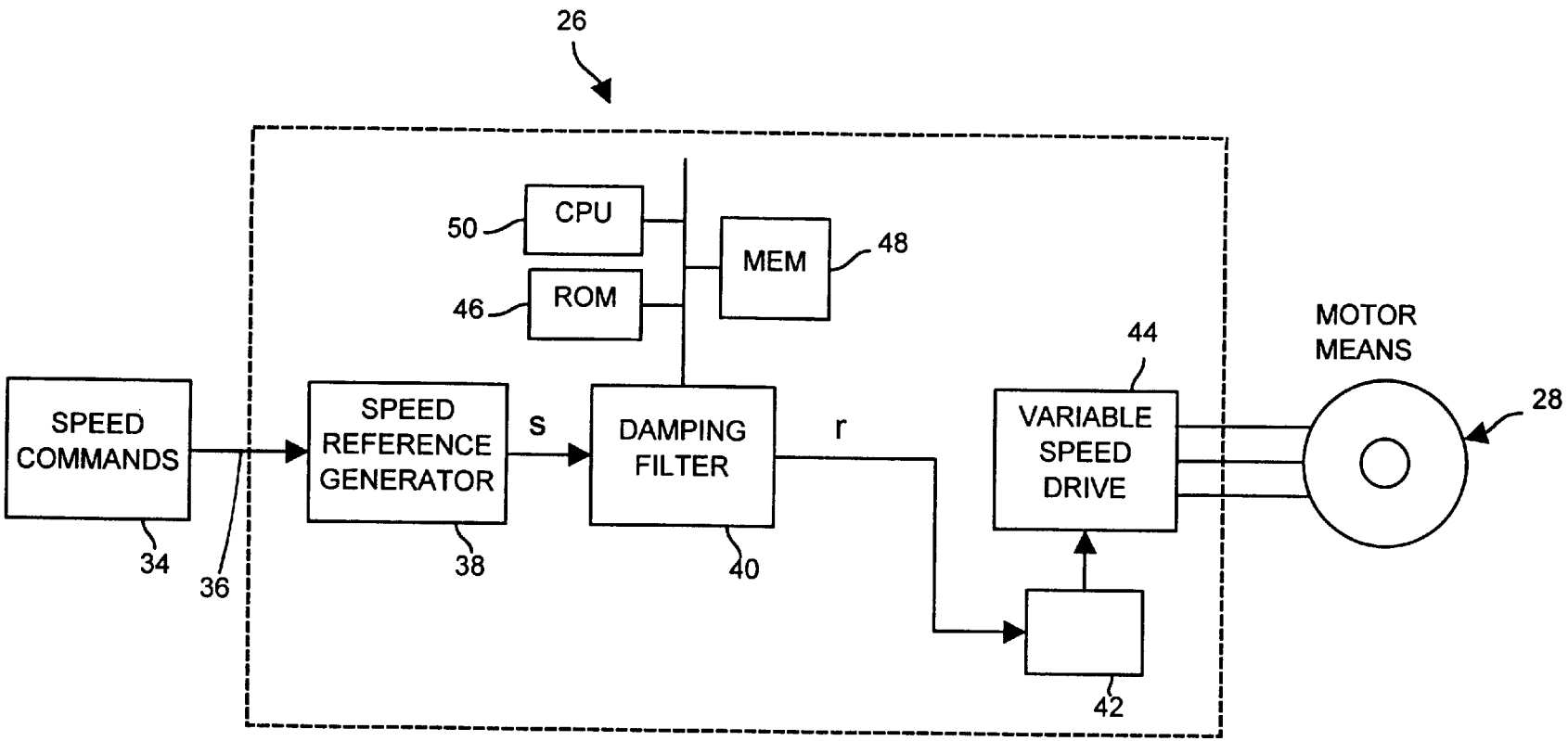
FIG. 2 is a block diagram of the crane speed control system incorporating the damping filter of the present invention.

FIG. 2 is a block diagram of the motor controller 26. The motor controller 26 has an input port 36 which accepts a signal representing a desired motion from the motion selector 24. In this example, the desired motion is the speed of the carriage 22, however, it is to be understood other motion such as acceleration may be similarly controlled and damped. The signal is sent to a speed reference generator 38 which generates a speed reference signal, s(t). The speed reference signal, s(t), is then modified by a damping filter 40 to produce an damping signal, r(t). The damping signal, r(t), may be filtered by an optional smoothing filter 42. The damping signal, r(t) is then sent to a variable speed drive 44 which controls-the motor 28. An optional rope length sensor 45 is coupled to the rope 30. The rope length sensor 45 measures rope length and may be employed in certain embodiments which will be detailed in Section 4.

The algorithm or program used in the damping filter 40 to produce the damping signal, r(t), is stored in a permanent memory 46. The permanent memory 46 may be a ROM, an EPROM, or a similar permanent storage device. A memory buffer 48 is used to store data and variables used by the damping filter 40. The memory buffer 48 may be random access memory, RAM, or another form of variable memory. The algorithm is processed by a central processing unit (CPU) 50. In the preferred embodiment, the permanent memory 46, memory buffer 48, and CPU 50 are contained in an Intel 87C196MC type motor control chip. However other microcontrollers or microprocessors may be used with appropriate hardware and software modifications.

The desired speed signal is received by the speed reference generator 38 to provide the speed reference signal s(t). The speed reference generator 38 generates the speed reference signal as a continuous signal from the desired speed signal. The speed reference signal s(t) is coupled to the damping filter 40 to provide a damping signal r(t) to control the variable speed drive 44. The hoisting rope 30 and load 32 are shown in phantom in FIG. 1 to indicate residual swing if the damping filter 40 was not applied to the speed reference signal, s(t) in the motor controller 28.

The damping signal r(t) is provided in a manner that causes load oscillations to be damped. The damping signal r(t) tends to follow the speed reference signal s(t) after a settling time associated with the damping filter 40.

The key steps in the filtering program used by the damping filter 40 of the present invention include:

(i) recording the speed reference signal s(t) into memory for providing a recent record of the reference signal s(t);

(ii) forming a linear combination of recent values of the speed reference signal s(t) obtained from the recent record to provide the instantaneous value of the damping signal r(t); and (iii) repeating step (ii) to provide the damping signal r(t).

The preferred method of accomplishing step (i), recording the speed reference signal into memory, includes periodically storing the present value of the speed reference signal, s(t), into the memory buffer 48 to record past and present values of the speed reference signal.

Figure 3:
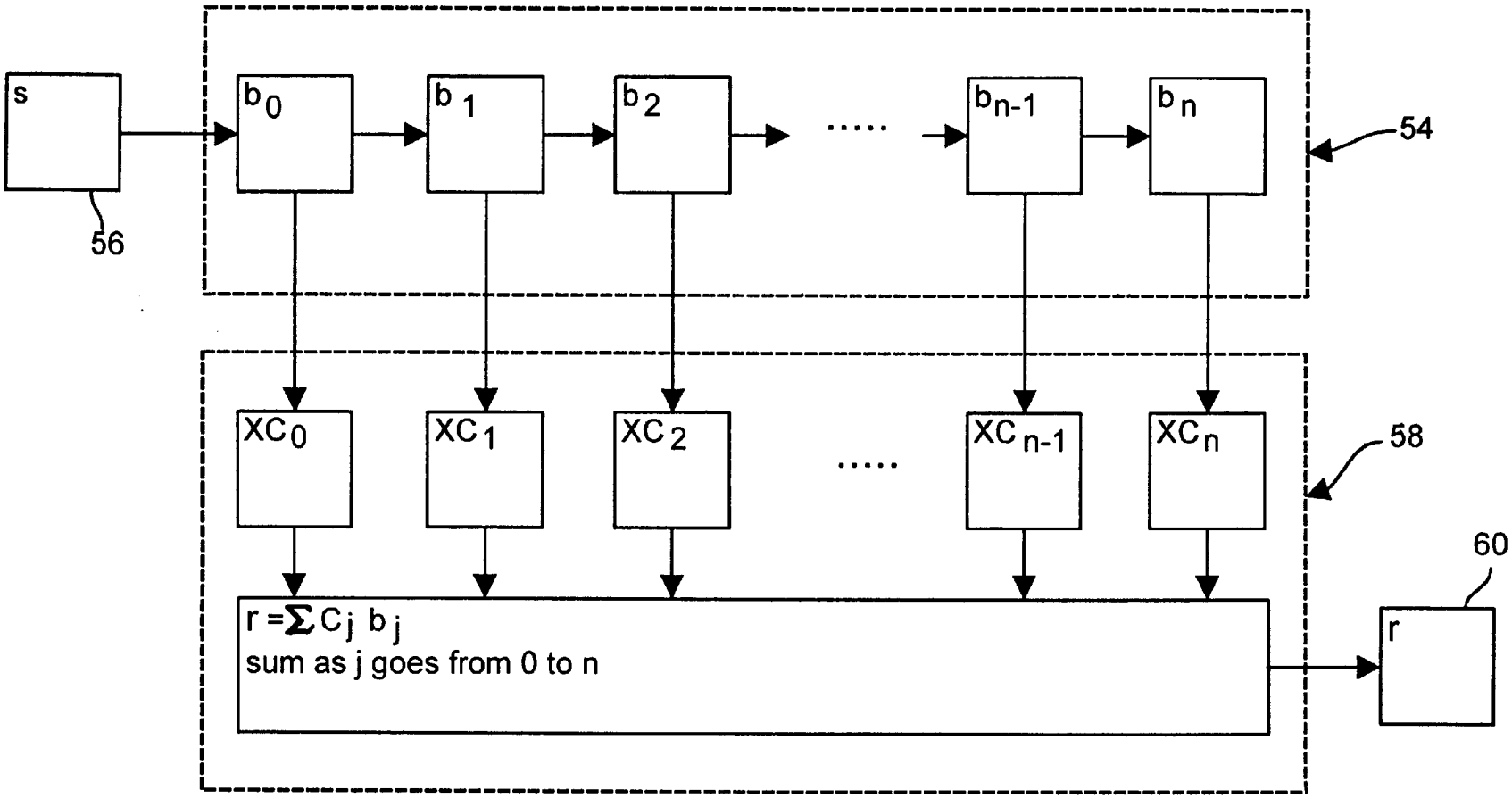
FIG. 3 is a flow diagram of one implementation of the present invention.
Figure 4A:
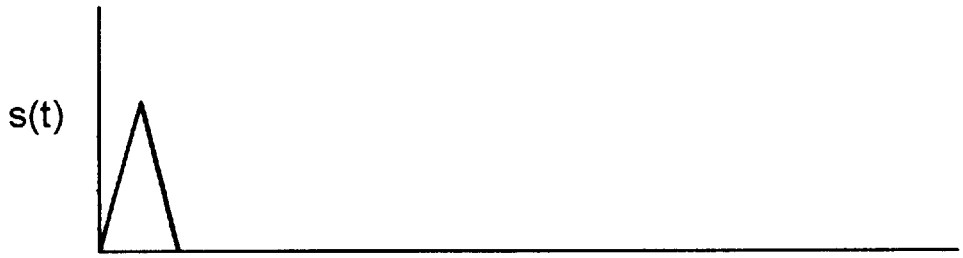
FIG. 4 is a graph illustrating the damping signal r(t) formed from the speed reference signal s(t) resulting from the fast-response version of the present invention.
Figure 4B:
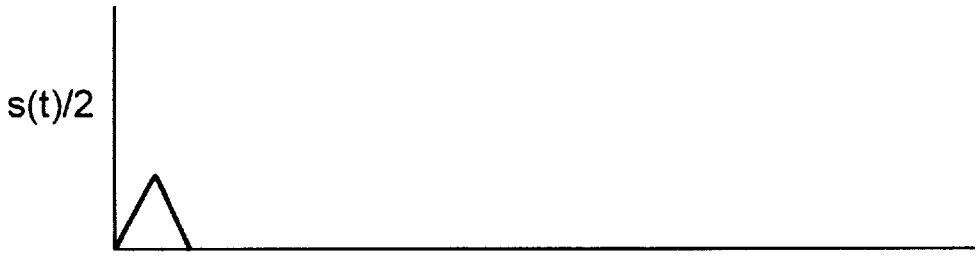
Figure 4C:
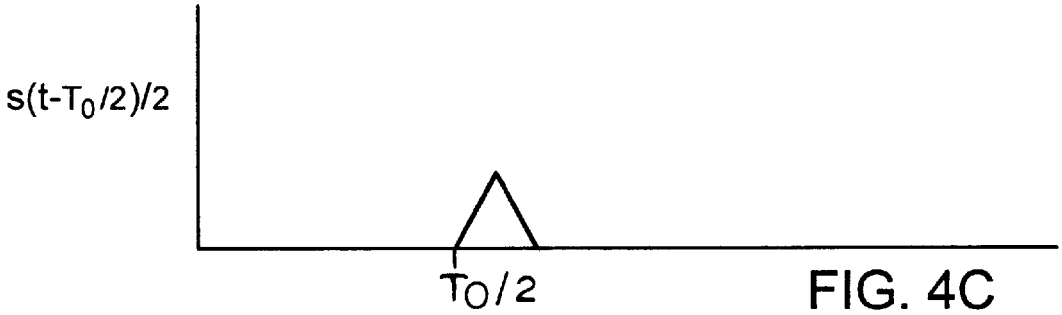
Figure 4D:
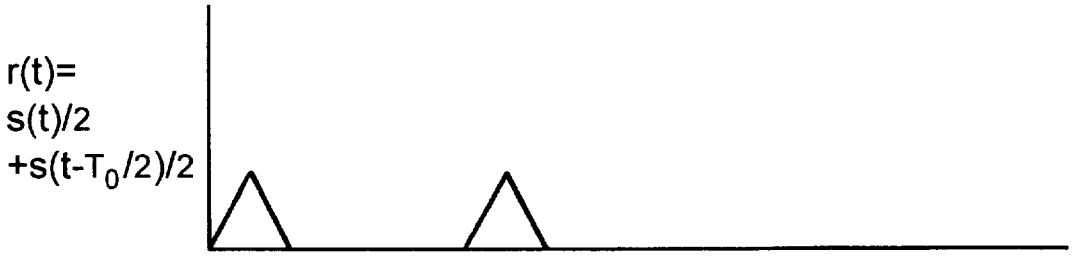
Figure 5A:
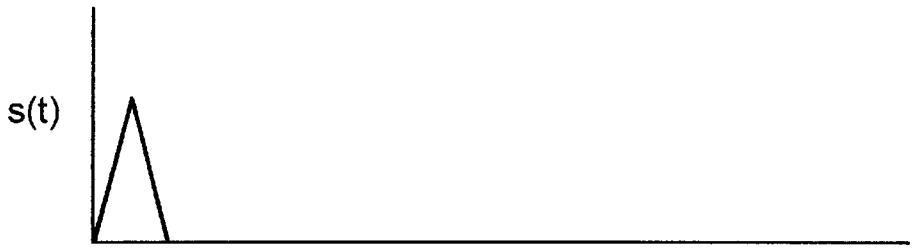
FIG. 5 illustrates the damping signal r(t) formed from the speed reference signal s(t) resulting from the one-point insensitive version of the present invention.
Figure 5B:
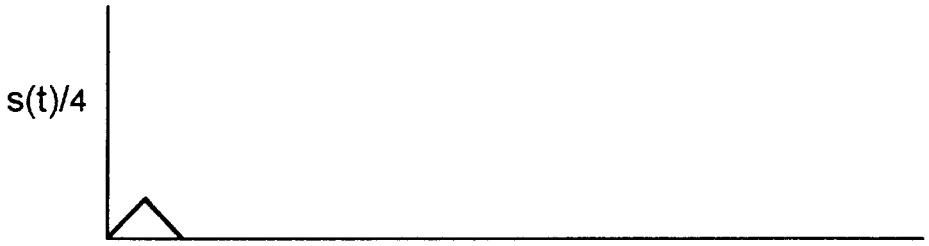
Figure 5C:
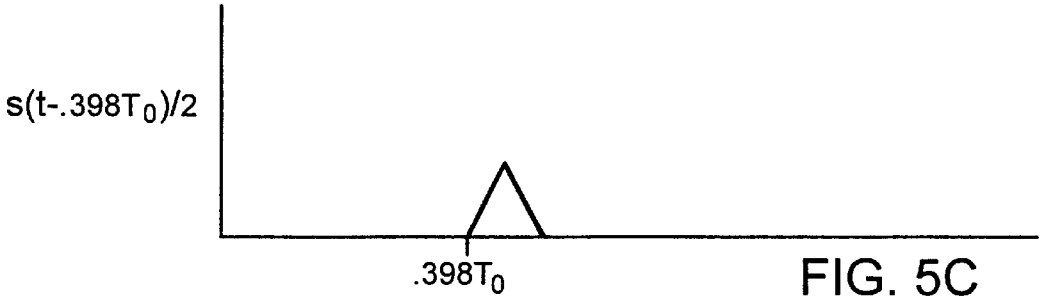
Figure 5D:
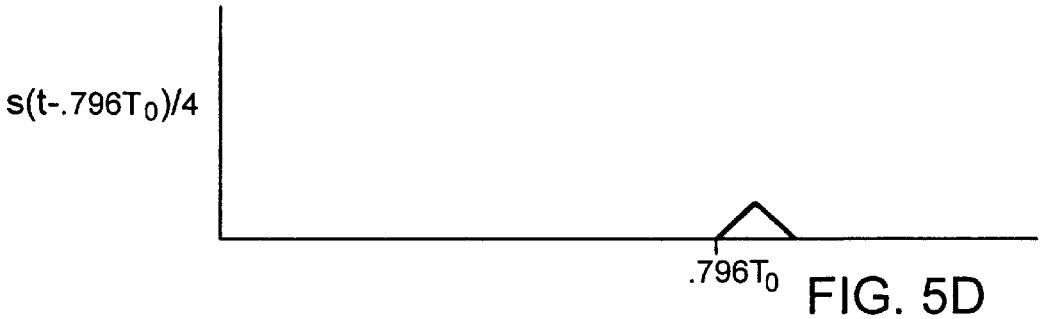
Figure 5E:
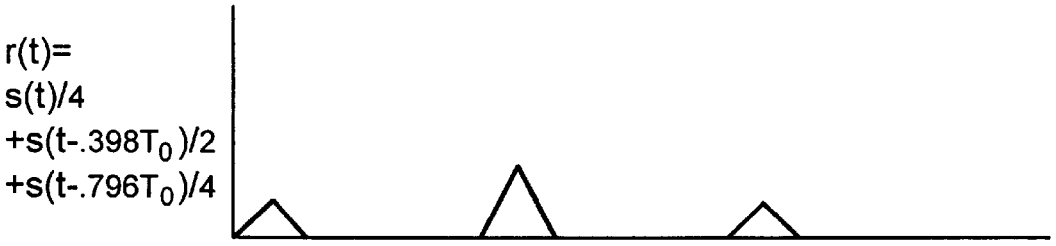

A block diagram representing the key steps used by the damping filter 40 of the present invention is depicted in FIG. 3. A convenient structure for the memory buffer 48 is a shifting array 54 shown in FIG. 3. The shifting array 54 has multiple (n+1) storage elements, or memory locations, each being an array variable labeled $b_0$ through $b_n$. New data is stored in the first array variable, $b_0$, while the data already stored in the array is shifted to the array variable with the next higher index, such that the data stored in $b_n$ is lost. Shifting the data is termed clocking the array 54. The new data representing the current speed reference signal s(t) is thus clocked into the array 54.

A linear combination of recent values of the speed reference signal is established by multiplying each data value contained in the shifting array by a coefficient and then summing these terms. The coefficients do not necessarily have to be the same for each memory location. The choice of coefficients determine the type of damping, if any, that will occur. In many cases, most of the coefficients will be zero resulting in only a few terms being summed and thereby simplifying calculations. In the case of the shifting array 54 with n+1 memory locations, there are n+1 coefficients ($C_0$ through $C_n$) of the linear combination. The instantaneous value of the damping signal is:

$$r(t) = \sum_{o}^{n} c_j b_j$$

where the sum indicated is taken as j goes from 0 to n. By repeatedly calculating the instantaneous value of the damping signal over time, the complete damping signal, r(t) is obtained.

As can be seen in FIG. 3, the shifting array 54 contains n+1 array variables $b_0$ through $b_n$. The speed reference signal s(t) is generated in block 56. This signal is stored into the first element $b_0$ of the array by clocking the shifting array 54. When the shifting array 54 is clocked, the values $b_0$ through $b_n$ stored in the array 54 are shifted to the array variables on the right, and the speed reference signal s(t) is stored in the first element $b_0$. This shift is represented by the arrows pointing to the right and connecting the boxes labeled $b_0$ through $b_n$ in FIG. 3. A linear combination of the data is formed in step 58. In step 58, the data in each memory location of the shifting array, for example, $b_j$, is multiplied by a corresponding coefficient, $C_j$. To complete the linear combination, these terms are then summed to form the instantaneous value of the damping signal r(t), which is output from the damping filter 40 in block 60.

A more general way to record the speed reference signal s(t) is to use two memory arrays for memory buffer 48. The first array records the values of the speed reference signal; and the second array records the times when the values in the first array where clocked in. This method of storing the reference signal allows flexibility when the arrays need to be clocked. For example, the speed reference signal may be clocked into the first array when the speed reference signal changes and the second array may record how long the speed reference signal remains at the value recorded in the first array. The time data in the second array is used to calculate the coefficients of the linear combination from the first array that form the damping signal. As will be explained in Section 4, another variation of this storage technique may be used to compensate for rope length changes as measured by a sensor.

Section 2: Embodiments Based On A Preset Rope Length

Three different versions of the present invention will now be described, (1) a "fast-response" version; (2) a "period-averaged" version; and (3) a "one-point insensitive" version. The fast-response and period-averaged versions will produce carriage motions similar to the prior art described above. The one-point insensitive version is one of a class of insensitive versions which all produce damping signals that dampen load oscillations over a large range of rope lengths.

Each of these three versions use a constant parameter, $L_0$, representing a preset rope length. The actual rope length is designated L and may be determined by the rope length sensor 45. For reference, the load's frequency of oscillation $\omega_0$, corresponding to this preset rope length is given by $$\omega_o = \sqrt{g / L_0}$$

and the period of oscillation, $T_0$, is defined as $2\pi/\omega_0$, with g being the acceleration due to gravity. The fast-response and period-averaged versions will produce carriage motions that will completely dampen load oscillations when the actual hoisting rope length L equals the preset reference length $L_0$. The one-point insensitive version will produce carriage motion that will reduce the amplitude of the load oscillation to less than 10% of the amplitude of the load oscillation with no damping filter when the actual hoisting rope length L is between 0.43 $L_0$ and $L_0$. As will be seen, the one-point insensitive version dampens oscillations better than ten to one for a range of rope lengths equivalent to 57% of the reference rope length $L_0$.

A fast-response version of the damping filter 40 calculates the damping signal as the simple average of two array variables. The first array variable represents the current value of the speed reference signal s(t) and the second variable represents the speed reference signal s(t) delayed by one-half the period associated with the reference rope length $L_0$. FIG. 4 graphs the components of this calculation and the resulting damping signal due to a speed reference signal, s(t), in the form of a short impulse. The initial short impulse, s(t), is graphed as the top trace. The second trace shows the short impulse at half magnitude or s(t)/2. The next trace shows the short impulse at half magnitude and delayed by one-half the period of oscillation, $s(t-T_0/2)/2$. The last trace shows the resulting damping signal r(t) as the sum of the two signals, s(t)/2, $s(t-T_0/2)/2)$, at half-magnitude.

This fast-response version uses the method of the present invention by clocking the speed reference signal s(t) into the shifting array 54 at a constant rate so that data will pass through the array in one-half period ($\pi/\omega_0$). The damping signal r(t) is set to be the simple average of the first and last elements of the array 54 every time the array 24 is clocked. Thus, all the coefficients of the linear combination are zero except the first, $C_0$, and the last, $C_n$, which are both one-half. Expressed as an equation, the output of the fast-response version is:

$$r(t)=0.5\ b_0+0.5\ b_n$$

To attain the desired clocking rate, data is clocked into the array 54 at intervals of $T_0/2n$.

The other open loop control method uses a period-averaged pattern. A period-averaged version of the present invention may be implemented by clocking the speed reference signal, s(t), into the shifting array 54 at a constant rate so that data will remain in the array 54 for one full period; and setting the damping signal to be the average of all the elements of the array 54 every time the array 54 is clocked. All the coefficients of the linear combination are 1/(n+1). Expressed as an equation, the output of the period-averaged version is $$r(t) = \sum_{o}^{n} b_j / (n+1)$$

where the sum of the data in the memory locations $b_0$ through $b_n$ is computed and n+1 is the number of data elements in the array 54. To attain the desired clocking rate, data is clocked into the array 54 at intervals of $T_0/(n+1)$.

The one-point insensitive version provides the damping signal as a weighted average of the speed reference signal s(t), the speed reference signal delayed by 0.398 $T_0$ and the speed reference signal delayed by 0.796 $T_0$. The signal delayed by 0.398 $T_0$ is to be weighted twice as much as the other two signals. The delays of 0.398 $T_0$ and 0.796 $T_0$ are selected to maximize damping at a 10:1 ratio as will be explained below.

FIG. 5 graphs the components of this calculation and the resulting damping signal, r(t), due to a speed reference signal, s(t), in the form of a short impulse. The first axis in FIG. 5 graphs the short impulse s(t). The second axis graphs the short impulse at quarter magnitude, s(t)/4. The next axis graphs the short impulse at half magnitude and delayed by 0.398 $T_0$, i.e., $s(t-0.398\ T_0)/2$. The next axis graphs the short impulse at quarter magnitude and delayed by 0.796 $T_0$, i.e., $s(t-0.796\ T_0)/4$. The last axis represents the resulting damping signal r(t) as the sum of these three reduced magnitude signals.

While there are many methods to implement this version with the present invention, two alternatives depend on whether the shifting array 54 has an even or odd number of elements. For an odd number of elements, this version may be implemented by clocking the speed reference signal into the shifting array 54 at a rate so that data will pass through the array in 0.796 $T_0$. The damping signal r(t) is set to be the sum:

$$r(t)=0.25\ b_0+0.5\ b_{n/2}+0.25\ b_n$$

where the index n/2 indicates the memory location in the middle of the array 54. A storage element $b_{n/2}$ is present if the shifting array 54 contains an odd number of variables. For an even number of variables, the speed reference signal s(t) delayed by 0.398 $T_0$ may be approximated by averaging the two array variables that share the middle storage locations. In this case the damping signal r(t) is expressed as:

$$r(t)=0.25\ b_0+0.25\ b_{(n-1)/2}+0.25\ b_{(n+1)/2}+0.25\ b_n$$

For either alternative of the one point insensitive version, data is clocked into the array 54 at intervals equaling 0.796 $T_0/n$.

Figure 6:
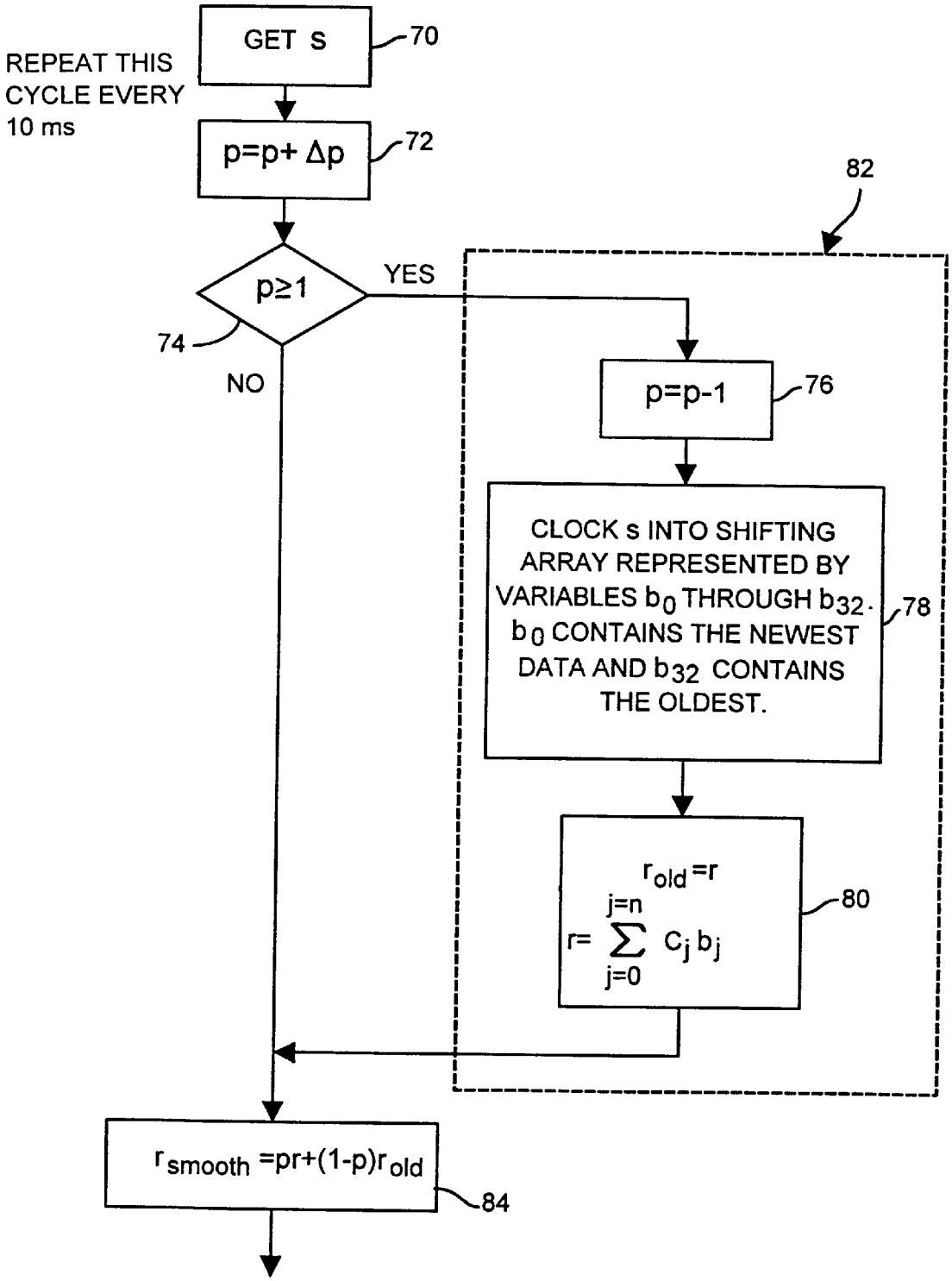
FIG. 6 is a flow diagram of a preferred embodiment of the present invention for applications where rope length information is conveyed by preset constants.

Referring now to FIG. 6, a flow diagram is shown representing a segment of a computer program for the general implementation of the present invention. The program segment is executed once every 10 ms although different intervals may be used depending on the application. The control interval of 10 ms represents a typical control interval in a variable speed motor drive. In the program segment, p is a counter used to time the execution of the loop 82. In the examples below, it will be desirable to have the change in p, expressed as Δp, to be a constant determined from the preset rope length so the loop will execute at a constant rate. The magnitude of Δp determines the rate at which the loop 82 is executed and hence the rate data is shifted into the array 54. It is selected to insure that data is clocked into the shifting array 54 at the appropriate intervals. This program segment is associated with a shifting array having 33 memory locations, $b_0$ through $b_{32}$. The corresponding 33 coefficients of the linear combination are predetermined constants, $C_0$ through $C_{32}$. Choosing these coefficients appropriately, along with an appropriate choice for Δp, determines the version of the invention that is implemented.

The program segment begins in step 70 by reading the speed reference signal, s(t), followed by step 72 which increments the variable p by Δp, where Δp is between zero and one. When p attains a value greater than or equal to one, loop 82 is executed and one is subtracted from the current value of p in a first step 76. Thus the loop 82 will execute at a frequency proportional to Δp. The shifting array 54 is then clocked to store the instant speed reference signal s(t) in step 78. The damping signal r(t) is calculated in step 80 by multiplying the values $b_0$ to $b_n$ in the array by the fixed constants $C_0$ to $C_n$ and then summing the results.

Before the damping signal r(t) is calculated, the value of the damping signal formed during the previous execution of loop 82 is stored in the variable $r_{old}$. The damping signal r(t) and the variable $r_{old}$ form the variable $r_{smooth}$ in step 84. The variable $r_{smooth}$ resembles the damping signal r(t) but is updated every control cycle and hence is smooth, i.e. it does not have any discontinuities that the damping signal r(t) may have. Coupling the damping signal r(t) to the variable speed drive 44 though the smoothing filter 42 is a useful technique to make the motion of the carriage 22 smoother. Practically any type of linear smoothing filter such as a moving average filter, low pass filter, or RC filter will preserve the damping effect of the damping signal. The smoothing filter 42 may be applied depending on how continuous the damping signal r(t) must be.

To adapt the program segment in FIG. 6 to the fast-response version of the invention discussed above, both $C_0$ and $C_{32}$ are ½ and all other coefficients are set to zero. Δp is $0.64/T_0$ which insures that data passes through the shifting array 54 in one-half the period of oscillation, $T_0$, as determined by the preset rope length.

To adapt the program segment in FIG. 6 to the period-averaged version discussed above, all the coefficients $C_0$ through $C_{32}$ will be ⅓. Δp is set to $0.33/T_0$ insuring that data remains in the shifting array 54 for one full period of oscillation as determined by the preset rope length.

To adapt the program segment corresponding to FIG. 6 to the one-point insensitive version discussed above, the coefficients $C_0$ and $C_{32}$ are set at 0.25, and $C_{17}$ is set to be 0.5. All the other coefficients are set to zero. Δp is set to $0.32/(0.796\ T_0)$ insuring that data passes through the shifting array in 0.796 $T_0$.

Section 3: Insensitive patterns

This section describes the mathematics underlying embodiments of the present invention where hoist rope length information is conveyed though present constants. A crane may be treated as a mechanical system with the pendulum motion of the load treated as a normal mode of oscillation. Exciting this normal mode may be avoided by driving the system with a signal that contains-little or no frequency component at the natural frequency of this normal mode. Thus filtering out the load's natural frequency of oscillation will dampen the swing.

The damping filter of the present invention is a finite impulse-response filter which operates by convoluting the input signal (the speed reference signal) with a predetermined pattern to provide the output signal. The pattern associated with each of the three embodiments of the damping filter in the previous section is represented by the coefficients $C_0$ through $C_n$. In general, to damp the load oscillation of a crane, the coefficients $C_0$ through $C_n$ need to be determined so that the resulting filter eliminates, or greatly reduces, the frequency of the damping signal for a range of load oscillation frequencies corresponding to desired lengths of the hoisting rope.

The effectiveness of any particular damping filter may be expressed by damping ratio of the filter or the associated pattern. A filter's damping ratio is defined as its normalized frequency-response function. As will be explained, the fast-response and period averaged filters have small damping ratios for a narrow range of oscillation frequencies, thus producing a narrow range of rope lengths for which good damping occurs. However, by creating a filter that dampens oscillations at two nearby frequencies, a broad range of oscillation frequencies having a small damping ratio is produced, corresponding to a filter that will dampen a large range of rope lengths. The one point insensitive method is the limit where these two damping frequencies are the same. By damping at three or more nearby frequencies, an even more effective filter may be produced.

In general, choosing the coefficients in the linear combination to provide the damping signal involves the notion of a pattern. A pattern for purposes of the present invention may be represented as a function W referred to as a damping function, or a set of damping constants, $N_k$, with an associated set of constant time intervals, $\tau_k$, or a combination of the damping function, damping constants, and time intervals. The damping function part of the pattern is to be a function of time of compact support and to be zero for negative times. A function of compact support indicates that the function is non-zero only in a bounded region. The damping constants, $N_k$, and associated constant time intervals, $\tau_k$, if present, are finite in number. The constant time intervals, $\tau_k$, are referred to as damping intervals. Each $\tau_k$ is associated with a corresponding $N_k$.

Figure 7:
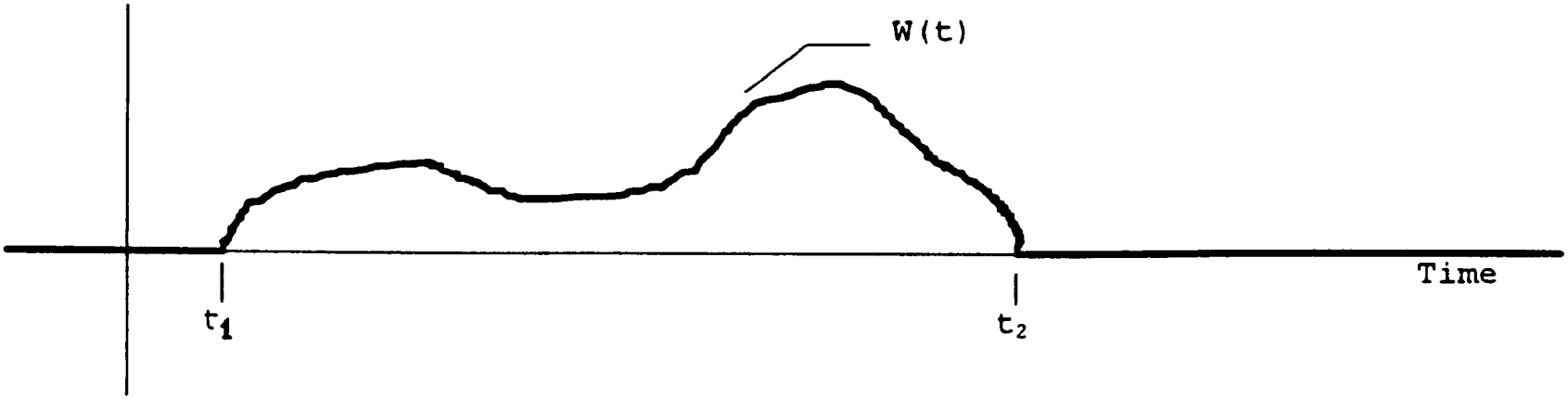
FIG. 7 is a graph illustrating the support of a function and the least upper bound of that support.

The support of a function is the closure of the set of all elements in its domain for which the function is non-zero. The term "compact," in this context, is a mathematical term implying that this set is bounded. Hence, a function of compact support W is one that vanishes outside some bounded region. A graph of a function of compact support W is shown in FIG. 7.

A pattern generates a natural way of mapping the speed reference signal s(t) to the output damping signal r(t) by the formula $$r(t)=\int_{-\infty}^{\infty} W(q)s(t-q)dq+\sum_k N_k s(t-\tau_k)$$

The process of mapping the speed reference signal to the output damping signal r(t) is termed, applying the pattern to the speed reference signal s(t). It is convenient to express patterns by showing their action on an arbitrary test function or on the speed reference signal s(t) instead of listing their components. A test function, denoted as f(t), is a function of time of compact support W. For example, the definition of a fast-response pattern is a pattern which has an action given by $$r(t)=0.5\ s(t)+0.5\ s(t-T_0/2)$$

for some fixed period $T_0$. The definition of a period-averaged pattern is a pattern which has an action given by $$r(t)=\frac{\int_0^{T_0} s(t-q)dq}{T_0}$$

for some fixed period $T_0$.

During a transversing run of the crane carriage 22, a signal is based on a pattern if there exists, corresponding to the signal, a test function such that the signal could be formed by applying the pattern to the test function. This requirement of compact support in the definition of a test function is important because almost any signal may result from a pattern applied to some function if it is not a compact support function. The acceleration profile, a(t), may be viewed as a signal and indicates the acceleration of the carriage 22 as a function of time. Hence, during a change from one speed to another, the acceleration profile, a(t), is based on a pattern if there exists, corresponding to the acceleration profile, a(t), a test function such that the acceleration profile could be formed by applying the pattern to the test function. For example, an acceleration profile a(t) of a carriage during a change of carriage speed is based on a fast-response pattern if a test function, f(t), and a fixed period, $T_0$ exist such that $$a(t)=0.5\ f(t)+0.5\ f(t-T_0/2).$$

A signal is substantially based on a pattern if, corresponding to the signal, a test function exists such that the signal is substantially equal to the resulting signal formed by applying the pattern to the test function.

A pattern is normalized if the pattern applied to the unit function gives the unit function. Normalized patterns preserve net distance change and net speed change. For example, if the damping signal, r(t), is produced by applying a normalized pattern to the speed reference signal, s(t), then the damping signal r(t) will produce the same net distance change at the end of a run as the speed reference signal, s(t), would have. Furthermore the damping signal, r(t), follows the speed reference signal, s(t), after an appropriate settling time.

Figure 8A:
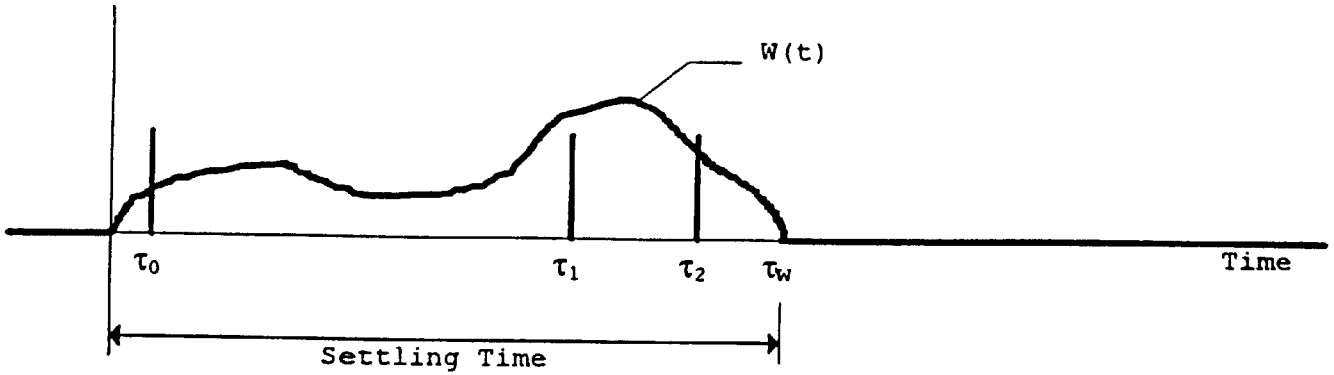
FIG. 8A illustrates a pattern with a settling time given by $\tau_w$, the least upper bound of the support of the associated damping function W(t)
Figure 8B:
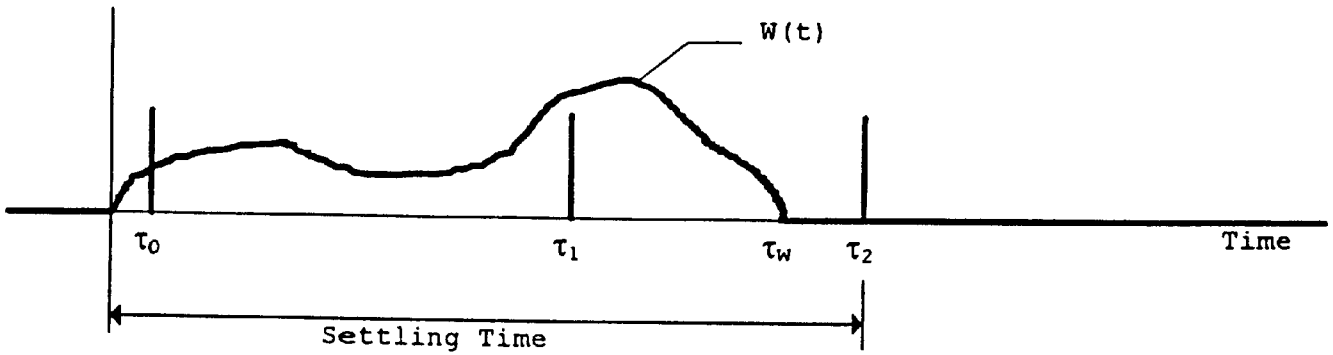
FIG. 8B illustrates a pattern with a settling time given by $\tau_2$, the greatest of the associated damping intervals.

The settling time of a pattern is defined as the largest damping interval in the pattern or as the least upper bound of the support of the associated damping function or the greater of these two values if both exist. The least upper bound of a bounded closed set is simply the largest value in the set. FIGS. 8A and 8B are graphs showing the damping function and damping intervals of two patterns and the associated settling times of each. In FIGS. 8A and 8B, the value of damping intervals $\tau_0$, $\tau_1$, and $\tau_2$ are represented by the position of the corresponding vertical line segments along the time axis. The least upper bound of the support of the associated damping function is denoted $\tau_W$. The settling time is a measure of time the damping signal produced by a pattern will lag behind the speed reference signal to which the pattern is applied.

The present invention may be viewed as one method of applying a pattern to the speed reference signal to provide a damping signal. The settling time of the filter 40 is equal to the settling time of the pattern on which the filter 40 is based. If the speed reference signal s(t) is clocked into the shifting array 54 at fixed constant intervals of time, Δt, when the moment the array 54 is clocked, each of its elements, $b_0$ to $b_j$, will represent the speed reference signal delayed by progressively greater multiples of At. For example, $b_0$ will represent s(t), the most recent value of the speed reference signal, $b_1$ will represent s(t−Δt), $b_2$ will represent s(t−2(Δt)), and so forth.

The part of the pattern having the damping constants and damping intervals applied to the speed reference signal s(t) may be approximated by interpolating the data in the array 54. For instance, each delayed signal, e.g., $s(t-\tau_k)$, may be approximated by interpolating between two consecutive array elements, ($b_j$ and $b_{j+1}$), where the indexes j and j+1 are determined because the damping interval $\tau_k$ lies between the times jΔt and (j+1)Δt. The general formula for $s(t-\tau_k)$ is:

$$s(t-\tau_k)=(((j+1)\Delta t-\tau_k)b_j+(\tau_k-j\Delta t)b_{j+1})/\Delta t$$

Using this interpolation method, the terms $N_k s(t-\tau_k)$ may be computed and then summed to obtain the damping constant and damping interval contribution to the action of the pattern on s(t).

The damping function of the pattern applied to the speed reference signal may be approximated by the expression $$r(t)=\Sigma W_j b_j$$

where the sum is taken as j goes from 0 to n, and the coefficients $W_j$ are:

$$W_j=\int_{(j-1/2)\Delta t}^{(j+1/2)\Delta t} W(q)dq$$

If all the damping constants of a pattern vanish leaving the pattern to consist of only a damping function part then a small reduction in the filter's settling time on the order of Δt may be realized by using the following formula for the coefficients $W_j$ $$W_j=\int_{j\Delta t}^{(j+1)\Delta t} W(q)dq$$

This second formula for $W_j$ is used to implement the period-averaged method discussed above. The pattern for the period-averaged version has its damping function equal to $1/T_0$ for the time between 0 and $T_0$ and zero for times greater that $T_0$, where $T_0$ is the period of oscillation associated with the preset rope length.

The application of a pattern on the speed reference signal, s(t) is the sum of the action of the damping function, and the action of the damping constants and damping intervals. Since each part is a linear combination of the variables in the shifting array 54, the entire action is also a linear combination. The coefficients of the linear combination are defined as based on a pattern if forming the linear combination provides a damping signal based on the pattern.

The interpolation method is used to form the linear combination if the array 54 is clocked at a rate independent of the period of the motion to be damped. A fast-response version of the filter may be represented by the pattern.

$$r(t)=0.5\ s(t)+0.5\ s(t-T_0/2)$$

For example, if the speed reference signal, s(t), is clocked into the shifting array 54 every 100 ms, and one-half of the period $T_0$ is 2.53 seconds, the value of s(t) that occurred 2.53 seconds in the past may then be computed from the data in the array. This is done by interpolating between the value at 2.50 seconds in the past, $b_{25}$, and the value at 2.60 seconds in the past, $b_{26}$. i.e. by summing 0.7 $b_{25}$ and 0.3 $b_{26}$. The output thus is given by $(b_0+0.7\ b_{25}+0.3\ b_{26})/2$, a linear combination of the data in the array 54.

Figure 9:
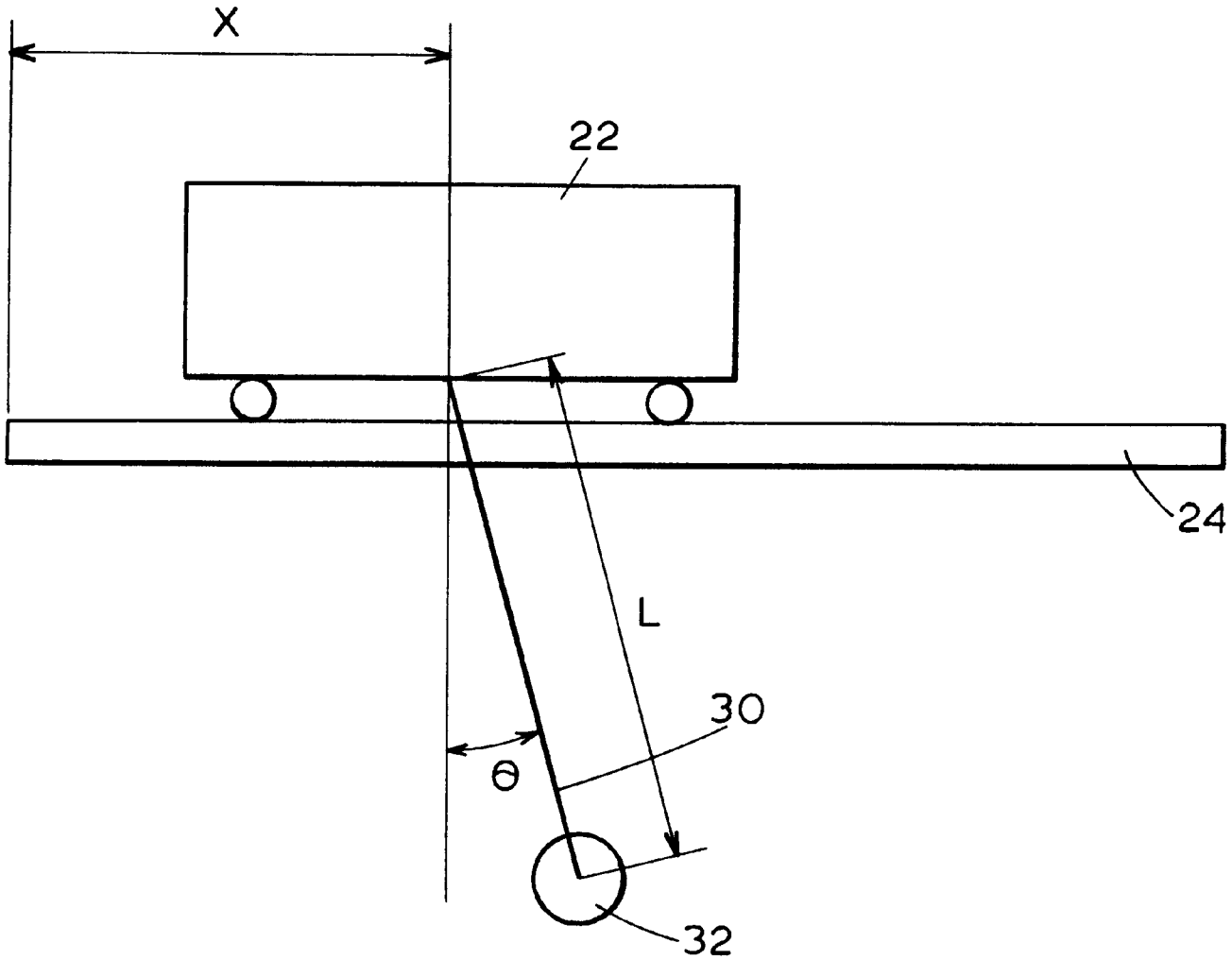
FIG. 9 is a free-body diagram of a crane carriage.

The fast-response, the one-point insensitive version, and the period-averaged versions all serve to dampen load swing. FIG. 9 is a free body diagram of the movable carriage 22 on the rail 24 with the load 32 suspended by the rope 30 from the carriage 22. The position of the carriage 22 is given by x, the length of rope by L, and the rope's angle of deflection by θ. The equation of motion for a small value of θ is given by EQU. 1: where ω is defined by $\omega=\sqrt{g/L}$ with g being the acceleration due to gravity.

$$\ddot{\theta}+\frac{2\dot{L}}{L}\dot{\theta}+\omega^2\theta+\frac{\ddot{X}}{L}=0 \qquad \text{EQU. 1}$$

Assuming the rope's length does not change, the equation of motion becomes:

$$\ddot{\theta}+\omega^2\theta=-\frac{\ddot{X}}{L} \qquad \text{EQU. 2}$$

EQU. 2 is a forced harmonic oscillator having natural frequency ω. If a traversing run of the carriage 2 begins at time $t_1$ where the initial condition is θ(t)=0 for $t\leqq t_1$, the general solution for θ at some future time $t_2$ is $$\theta(t_2)=\frac{1}{2i\omega}\left[e^{i\omega t_2}\int_{t_1}^{t_2}\frac{x}{L}e^{-i\omega t}dt-e^{i\omega t_2}\int_{t_1}^{t_2}\frac{x}{L}e^{-i\omega t}dt\right] \qquad \text{EQU. 3}$$

Assuming that the carriage 22 has a constant velocity for $t<t_1$, and performs a series of motions for $t_1<t<t_2$, and finishes at some new constant velocity at time $t_2$, it follows that there will be no further oscillations after time $t_2$ if and only if $$\int_{t_1}^{t_2}\ddot{x}e^{i\omega t}dt=0 \qquad \text{EQU. 4}$$

EQU. 4 is the damping equation indicating that the filter must produce an output signal which will cause accelerations with no frequency component of frequency ω to create damping.

A pattern is defined to have no frequency component at frequency ω if the pattern applied to the function exp(iωt) is zero. A crucial property of patterns for damping load oscillations in open loop systems is that the damping signal obtained by applying a pattern to the speed reference signal will have zero frequency component at any frequency that the pattern has a zero component.

An arbitrary speed reference signal may be transformed into a damping signal by applying a pattern. The resulting damping signal will resemble the speed reference signal but any frequency component that the pattern lacks will also be lacking in the damping signal. Using the damping signal to control the speed of the crane will cause the crane speed to be proportional to the damping signal. The acceleration of the crane will be missing any frequency component the damping signal is missing, causing damping to occur for rope lengths corresponding to frequency components missing from the pattern.

The output damping signal, r(t), of the fast-response version of the filter is derived from the pattern r(t)=0.5 s(t)+0.5 s(t−$T_0$/2) where s(t) is the speed reference signal. By substituting exp(iωt)for s(t), exp(iω(t−$T_0$/2)) for s(t−$T_0$/2) and setting ω to be $\omega_0$, the resulting r(t) is zero. Hence, the pattern has a zero frequency component at frequency $\omega_0$ and will dampen swing when the frequency of oscillation ω associated with the actual rope length equals $\omega_0$.

The pattern associated with the period-averaged version also lacks a frequency component at frequency $\omega_0$. This is because the average of exp(i$\omega_0$t) over one period is zero.

In general, the pattern associated with the one-point insensitive version is r(t)=0.25 s(t)+0.5 s(t−$a_0T_0$/2)+0.25 s(t−$a_0T_0$) where $a_0$ is a constant. In the previously discussed one-point insensitive version, $a_0$ was set to 0.796. In general, the one-point insensitive version has a zero frequency component at the frequency having a period $a_0T_0$.

A two-point insensitive version dampens load swing completely at two different preset frequencies of oscillation. The frequencies are close enough to each other to produce a wide range of frequencies, or rope lengths, for which desired damping will occur. For two periods of oscillation, $a_0T_0$ and $a_1T_0$, $a_0$ and $a_1$ being constants, the two-point insensitive pattern that eliminates oscillations with these periods is $$r(t)=0.25\ s(t)+0.25\ s(t-a_0T_0/2)+0.25\ s(t-a_1T_0/2)+0.25\ s(t-(a_0+a_1)T_0/2).$$

This pattern, applied to the speed reference signal, s(t), provides the output damping signal as the average of the speed reference signal s(t) with three time-delayed versions of s(t). By setting the two periods equal, i.e. $a_0=a_1$, the one-point insensitive pattern is produced retaining the broad damping range of the two-point insensitive pattern.

The two-point insensitive version damping filter may be implemented by coupling two fast-response filters in series. The first filter eliminates oscillations with period $a_0T_0$ while the other filter eliminates oscillations with period $a_1T_0$. The filters may be placed in either order. Because of the linearity of the filters, oscillations at both periods will be damped. In fact three or more frequencies may be damped by placing the appropriate number of fast-response filters in series. The functionality of this series may likewise be duplicated by one filter representing the action of a complex pattern. A pattern that eliminates three preset periods of oscillation, $a_0T_0$, $a_1T_0$, and $a_2T_0$, and which may be referred to as a three-point insensitive pattern, is:

$$\begin{aligned}r(t)=&\ .125s(t)+.125s(t-a_0T_0/2)+\\&.125s(t-a_1T_0/2)+.125s(t-a_2T_0/2)+\\&.125s(t-(a_0+a_1)T_0/2)+.125s(t-(a_0+a_2)T_0/2)+\\&.125s(t-(a_1+a_2)T_0/2)+.125s(t-(a_0+a_1+a_2)T_0/2).\end{aligned}$$

TABLE 1 outlines fast-response, period-averaged, one-point insensitive, two-point insensitive, and three-point insensitive patterns discussed above, along with their associated settling times. The fast-response and the period-averaged patterns have the period $T_0$ scaled with the constant $a_0$ so that both eliminate the frequency with a period equal to $a_0T_0$. Scaling the period allows shifting the damped frequencies and periods relative to those associated with the preset rope length to compare the ability of each pattern to dampen over a broad range of rope lengths.

TABLE 1

| VERSION | PATTERN | SETTLING TIME | DAMPING RATIO |
|---|---|---|---|
| Past Response | $r(t) = .5s(t) + .5s(t-a_0T_0/2)$ | $a_0T_0/2$ | $\left\lvert \frac{1+\exp\left(-i\pi a_0\sqrt{\frac{L_0}{L}}\right)}{2} \right\rvert$ |
| Period-Averaged | $r(t) = \frac{\int_0^{a_0T_0} s(t-q)\,dq}{a_0T_0}$ | $a_0T_0$ | $\frac{1}{2\pi a_0}\sqrt{\frac{L}{L_0}}\left\lvert I-\exp\left(-2i(\pi a)_0\sqrt{\frac{L_0}{L}}\right)\right\rvert$ |
| One-Point Insensitive | $r(t) = .25s(t) + .5s(t-a_0T_0/2) + .25s(t-a_0T_0)$ | $a_0T_0$ | $\left\lvert \frac{1+\exp\left(-i\pi a_0\sqrt{\frac{L_0}{L}}\right)}{2} \right\rvert^2$ |
| Two-Point Insensitive | $r(t) = .25s(t) + .25s(t-a_0T_0/2) + .25s(t-a_1T_0/2) + .25s(t-(a_0+a_1)T_0/2)$ | $(a_0+a_1)T_0/2$ | $\left\lvert \frac{1+\exp\left(-i\pi a_0\sqrt{\frac{L_0}{L}}\right)}{2} \right\rvert \cdot \left\lvert \frac{1+\exp\left(-i\pi a_1\sqrt{\frac{L_0}{L}}\right)}{2} \right\rvert$ |
| Three-Point Insensitive | $r(t) = .125s(t) + .125s(t-a_0T_0/2) + .125s(t-a_1T_0/2) + .125s(t-a_1T_0/2) + .125s(t-(a_0+a_1)T_0/2) + .125s(t-(a_0+a_2)T_0/2) + .125s(t-(a_1+a_2)T_0/2) + .125s(t-(a_0+a_1+a_2)T_0/2)$ | $(a_0+a_1+a_2)T_0/2$ | $\left\lvert \frac{1+\exp\left(-i\pi a_0\sqrt{\frac{L_0}{L}}\right)}{2} \right\rvert \cdot \left\lvert \frac{1+\exp\left(-i\pi a_1\sqrt{\frac{L_0}{L}}\right)}{2} \right\rvert \cdot \left\lvert \frac{1+\exp\left(-i\pi a_2\sqrt{\frac{L_0}{L}}\right)}{2} \right\rvert$ |

The broad range of damping associated with the insensitive versions is best understood in terms of a damping ratio. The damping ratio indicates the amount by which load oscillations will be reduced if the speed of the carriage is controlled by the damping signal r(t) provided by applying the pattern to the speed reference signal s(t) compared to controlling the speed directly with the speed reference signal s(t). A damping ratio of a pattern is defined as the absolute value of the pattern applied to exp(iωt), (ω being a constant during this process), and then dividing by the pattern applied to the unit function. The damping ratio can be viewed as a function of rope length by substituting $$\sqrt{\frac{g}{L}}$$

for ω. In general, the damping ratio may be expressed as follows:

damping ratio =

-continued $$\left\lvert \frac{\int_{-\infty}^{\infty} W(q)\exp\left(i\sqrt{\frac{g}{L}}(t-q)\right)dq + \sum N_k \exp\left(i\sqrt{\frac{g}{L}}(t-\tau_k)\right)}{\exp\left(i\sqrt{\frac{g}{L}}\,t\right)} \right\rvert$$

Two important properties associated with a pattern are: 1) the settling time; and 2) the range of rope lengths where the damping ratio is below a desired level. Whether or not a particular pattern is appropriate for a given application depends on these two properties. The particular application determines the appropriate settling time, the level of tolerable load oscillation and the range of rope length needed to damp to this level.

Figure 11:
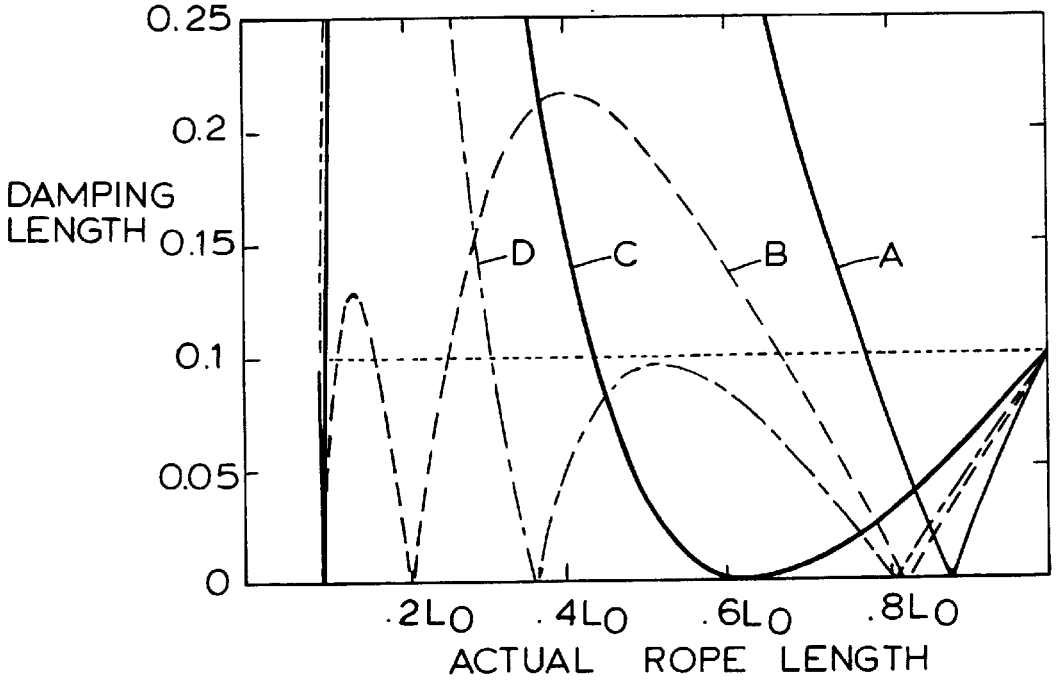
FIG. 11 is a graph illustrating damping characteristics of the fast-response, period averaged, one-point insensitive, and two-point insensitive patterns for damping below the 0.10 damping ratio.
Figure 12:
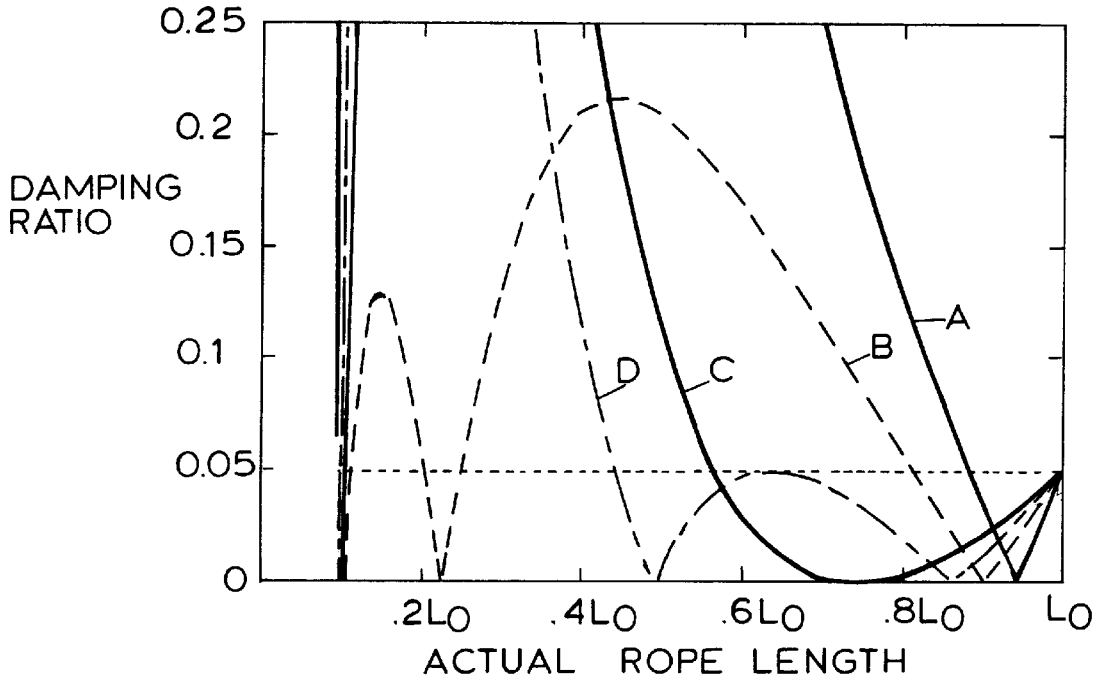
FIG. 12 is a graph illustrating damping characteristics of the fast-response, period averaged, one-point insensitive, and two-point insensitive patterns for damping below the 0.05 damping ratio.
Figure 13:
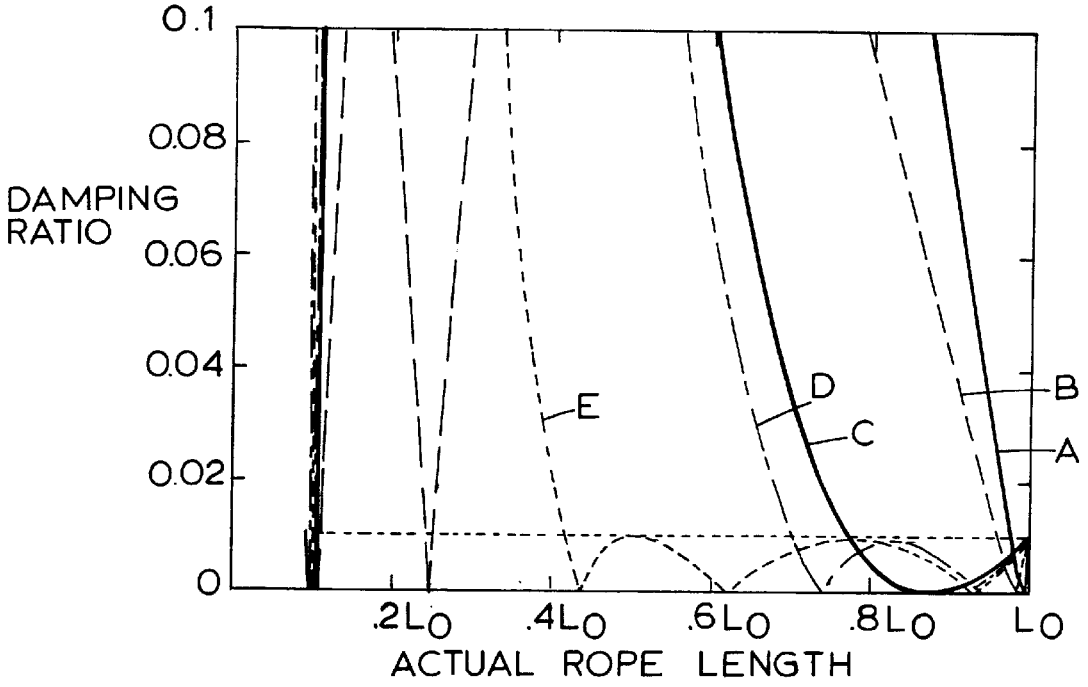
FIG. 13 is a graph illustrating damping characteristics of the fast-response, period averaged, one-point insensitive, two-point insensitive patterns, and three-point insensitive patterns for damping below the 0.01 damping ratio.

FIGS. 10 through 13 are graphs of the damping ratio vs. the length of the hoisting rope for the fast-response, period averaged, one-point insensitive and two-point insensitive versions of the invention. FIG. 13 also includes a curve for the three-point insensitive version. Each graph is characterized by a straight horizontal damping line representing a constant damping ratio.

Figure 10:
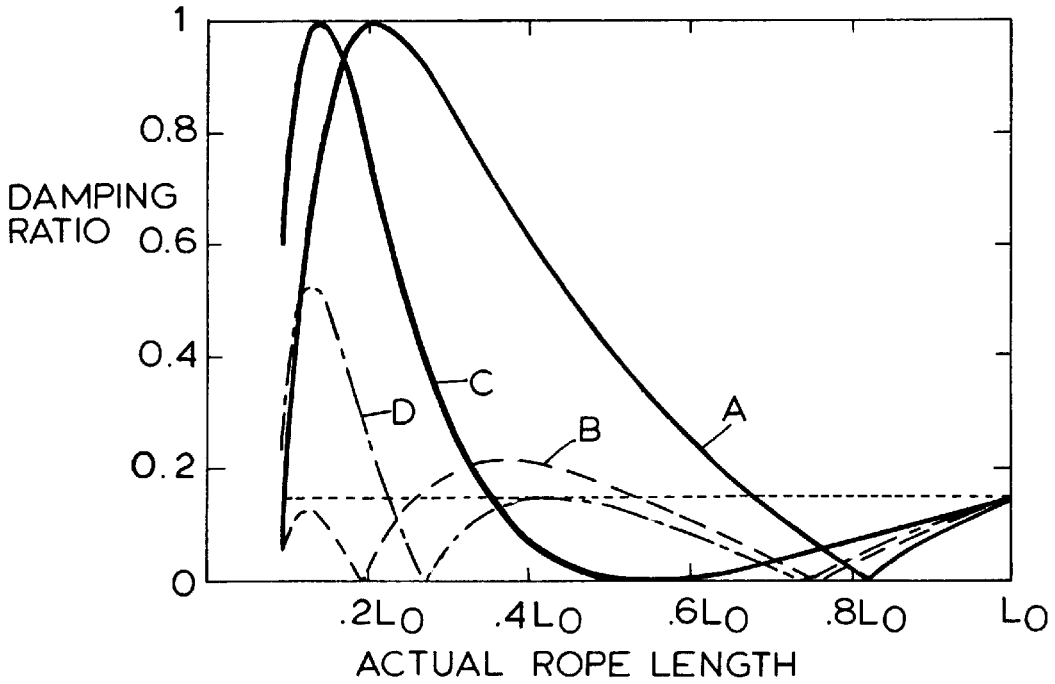
FIG. 10 is a graph of the damping ratios associated with the fast-response, period averaged, one-point insensitive, and two-point insensitive patterns for damping below the 0.15 damping ratio.

In FIG. 10 the damping line represents a damping ratio of 0.15. For the actual rope lengths that the damping ratio of a pattern lies under this line, swing will be reduced to less than 15% of that which would have occurred if the damping filter of the present invention was not used. Table 2 shows the patterns used to generate the damping ratio curves along with their associated settling times.

TABLE 2

| TRACE | VERSION | PATTERN | SETTLING TIME |
|---|---|---|---|
| A | Fast Response | $r(t) = .5s(t) + .5s(t-.452T_0)$ | $.452T_0$ |
| B | Period-Averaged | $r(t) = \frac{\int_0^{.87T_0} s(t-q)\,dq}{.87T_0}$ | $.87T_0$ |
| C | One-Point Insensitive | $r(t) = .25s(t) + .5s(t-.373T_0) + .25s(t-.746T_0)$ | $.746T_0$ |
| D | Two-Point Insensitive | $r(t) = .25s(t) + .25s(t-.26T_0) + .25s(t-.43T_0) + .25s(t-.69T_0)$ | $.69T_0$ |

The specific patterns in TABLE 2 are derived from the general patterns in TABLE 1. The period scaling constants $a_0$, $a_1$, and $a_2$ used in TABLE 1 were chosen for each curve so the damping ratio curves meet the damping line when the actual rope length equals the reference length $L_0$ and so the curves are beneath the damping line for the largest possible contiguous range of rope lengths for rope lengths less than $L_0$. One method for determining the period scaling constants, $a_0$, $a_1$, and $a_2$ for FIGS. 10–13 uses a graphing program on a computer. In the preferred embodiment, MathCAD is run on an IBM type personal computer to determine the constants. Specifically, the damping ratio of each pattern is plotted and the period scaling constants are varied until the plot of the damping ratio meets the desired damping line at $L=L_0$ and the damping ratio remains below the damping line for the largest possible region of rope lengths less than $L_0$. As will be seen in FIG. 11, the choice for $a_0$ as 0.796 causes the one-point pattern to meet the 10 to 1 damping level for rope lengths L equalling the present rope length $L_0$.

With regard to FIG. 10, the damping ratio of the fast-response version (curve A) remains under the 0.15 level for actual rope lengths between 0.68 $L_0$ and $L_0$. Assuming that the preset rope length is the distance from the load's suspension point to the ground, this fast-response version may be used to reduce swing better than six to one for a range of rope lengths equaling 32% of the full range of rope length. This range of rope lengths, referred to as the damping range, includes the ground level where damping is most important. Thus, the reduction in swing would not be below the 15% level if the load was raised to over 32% of full height. The other three curves (B–D) each represent an even broader damping range below the 15% damping ratio level than the fast-response version. The damping ratio of the period-averaged version (curve B) is below the 15% damping ratio level for rope lengths between 0.53 $L_0$ and $L_0$, resulting in a damping range equal to about 47% of the preset rope length. The one-point insensitive version (curve C) has a damping range between 0.35 $L_0$ and $L_0$, encompassing about 65% of the preset rope length. The two-point insensitive version (curve D) has a damping range between 0.23 $L_0$ and $L_0$, encompassing about 77% of the preset rope length. The two-point insensitive version has two rope lengths at which the damping ratio is zero. These lengths are determined by the period scaling constants $a_0$ and $a_1$ of the pattern. The period scaling constants for these constants were chosen so that the damping ratio is 0.15 at $L_0$ but the bulge of the curve in the region about 0.4 $L_0$ touches the 0.15 damping ratio line to maximize the rope length for which the damping ratio is equal or below the damping line.

These curves suggest one way to classify patterns as being able to dampen swing over a range of rope lengths better than either a fast-response pattern or a period-averaged pattern. The pattern is of type 1 if a rope length $L_0$ exists such that the pattern's damping ratio is equal to or below the 0.15 level for rope lengths between 0.5 $L_0$ and $L_0$ and the pattern's settling time is less than 1.6 $T_0$, $T_0$ being the period of oscillation associated with the rope length $L_0$. According to this definition, only the one and two-point versions in FIG. 10 (curves C and D) are type 1. The settling time is required because the period-averaged version would meet the other requirements of the definition of type 1, if the period scaling constant $a_0$ from TABLE 1 was tuned to 1.7 to thereby give the period-averaged version a settling time of 1.7 $T_0$.

Figure 14:
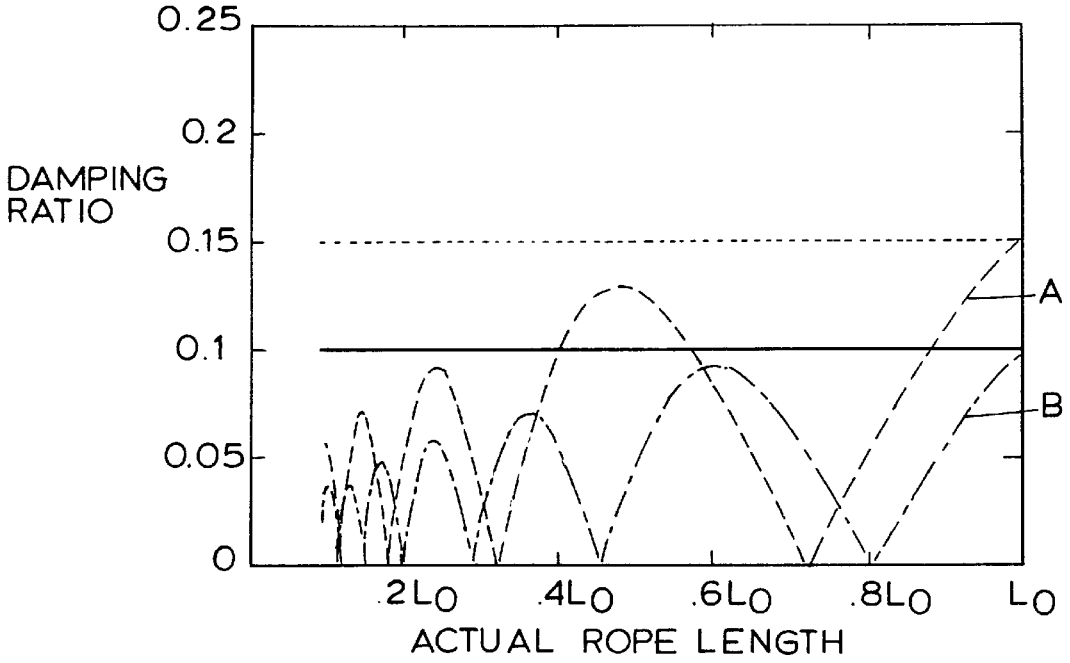
FIG. 14 is a graph illustrating damping characteristics of two period averaged patterns with parameters tuned to damp below the 0.15 and 0.10 damping ratios.

FIG. 14 displays the period-averaged version where $a_0$=1.7 (curve A). The damping ratio is below 0.15 for all lengths of rope between 0 and $L_0$. The associated patterns are charted below in Table 3.

TABLE 3

| TRACE | VERSION | PATTERN | SETTLING TIME |
|---|---|---|---|
| A | Period-Averaged | $r(t) = \frac{\int_0^{1.7T_0} s(t-q)\,dq}{1.7T_0}$ | $1.7T_0$ |
| B | Period-Averaged | $r(t) = \frac{\int_0^{2.69T_0} s(t-q)\,dq}{2.69T_0}$ | $2.69T_0$ |

FIG. 11 is characterized by a horizontal line representing a damping ratio of 0.10, or a reduction of load swing by a ratio of ten to one. For the rope lengths for which the pattern's damping ratio lies under this line, swing will be reduced to less than 10% of swing without the damping filter of the present invention. Again, the four curves (A–D) represent the damping ratios of a fast-response version, a period-averaged version, a one-point insensitive version and a two-point insensitive version. The corresponding patterns are charted in Table 4:

TABLE 4

| TRACE | VERSION | PATTERN | SETTLING TIME |
|---|---|---|---|
| A | Fast Response | $r(t) = .5s(t) + .5s(t-.468T_0)$ | $.468T_0$ |
| B | Period-Averaged | $r(t) = \frac{\int_0^{.907T_0} s(t-q)\,dq}{.907T_0}$ | $.907T_0$ |
| C | One-Point Insensitive | $r(t) = .25s(t) + .5s(t-.398T_0) + .25s(t-.796T_0)$ | $.796T_0$ |
| D | Two-Point Insensitive | $r(t) = .25s(t) + .25s(t-.3T_0) + .25s(t-.448T_0) + .25s(t-.748T_0)$ | $.748T_0$ |

Compared to FIG. 10 the settling times are longer and the damping ranges are smaller, showing the tradeoff between decreasing the magnitude of load oscillations and increasing the damping range or decreasing the settling time. The fast-response version (curve A) has reduced its damping range from 32% in FIG. 10 to about 22% of the preset rope length $L_0$ in FIG. 11. This results in a damping range from 0.78 $L_0$ to $L_0$. The period-averaged version (curve B) dampens 35%, the one-point version (curve C) dampens 57% and the two-point version (curve D) dampens 70%. For smaller damping ratios, the one and two-point insensitive versions (curves C and D) begin to produce much larger damping ranges than either the fast-response or period-averaged versions.

These curves suggest a second way to classify patterns as being able to dampen swing over a range of rope lengths better than either a fast-response pattern or a period-averaged pattern. A pattern may be defined as type 2 if a rope length $L_0$ exists such that the damping ratio of the pattern is below 0.10 for rope lengths between 0.6 $L_0$ and $L_0$ and if the settling time is less than 2.6 $T_0$, $T_0$ being the period of oscillation associated with the rope length $L_0$. According to this definition, only the one and two-point insensitive patterns (curves C and D) are type 2. The settling time requirement is necessary since the period-averaged version period scaling constant $a_0$ from TABLE 1 is tuned to 2.69 thereby producing a settling time of 2.69 $T_0$, to meet the other requirements of the definition of type 1. FIG. 14 shows the period-averaged version with $a_0$=2.69 (curve B) where the damping ratio is below 0.10 for all lengths of rope between 0 and $L_0$.

Similar to the manner in which we have defined patterns of type 1 and type 2, we may define patterns of type 3. A pattern is type 3 if a rope length $L_0$ exists such that the pattern's damping ratio is below 0.08 for rope lengths between 0.65 $L_0$ and $L_0$ and if the pattern's settling time is less than 3.5 $T_0$, $T_0$ being the period of oscillation associated with the rope length $L_0$. Again, the fast-response and period-averaged patterns are excluded from type 3.

Patterns of type 1, type 2, or type 3 produce a wider range of rope lengths for which the damping level is below 0.15, 0.10, or 0.08, respectively, than either the fast-response pattern or the period-averaged pattern in present use. Thus, an insensitive pattern is defined as a pattern belonging to either type 1, or type 2, or type 3.

FIG. 12 is characterized by a horizontal line representing a damping ratio of 0.05, or a reduction of load swing by approximately a ratio of twenty to one. For the actual rope lengths that the pattern damping ratio is below this line, swing will be reduced to less than 5% of the swing without the damping filter of the present invention. Again, the four curves (A–D) represent the damping ratios of a fast-response version, a period-averaged version, a one-point insensitive version and a two-point insensitive version. The patterns associated with each curve are set forth in Table 5.

TABLE 5

| TRACE | VERSION | PATTERN | SETTLING TIME |
|---|---|---|---|
| A | Fast Response | $r(t) = .5s(t) + .5s(t-.484T_0)$ | $.484T_0$ |
| B | Period-Averaged | $r(t) = \frac{\int_0^{.95T_0} s(t-q)\,dq}{.95\,T_0}$ | $.95T_0$ |
| C | One-Point Insensitive | $r(t) = .25s(t) + .5s(t-.43T_0) +$ | $.86T_0$ |

TABLE 5-continued

| TRACE | VERSION | PATTERN | SETTLING TIME |
|---|---|---|---|
| D | Two-Point Insensitive | $r(t) = .25s(t-.86T_0) + .25s(t) + .25s(t-.35T_0) + .25s(t-.465T_0) + .25s(t-.815T_0)$ | $.815T_0$ |

Compared to FIG. 11, the settling times are longer and the damping ranges are smaller. The fast-response version (curve A) dampens 11% of the reference rope length, the period-averaged version (curve B) dampens 18%, the one-point version dampens 43% (curve C) and the two-point version dampens 55% (curve D). The one and two-point insensitive versions thus produce much larger damping ranges than either the fast-response or period-averaged version at this damping level.

Even larger rope length ranges for minimal damping may be obtained by constructing filters that eliminate three or more frequencies. Such filters may be constructed by putting three or more appropriately tuned fast-response filters in series or constructing an equivalent large filter that averages the input signal with many time-delayed versions of the input signal. FIG. 13 displays the previous four versions of the damping filter (curves A–D) tuned to maximize their damping range below the 0.01 damping ratio level, along with a three-point insensitive version. The patterns associated with each curve are set forth in Table 6.

TABLE 6

| TRACE | VERSION | PATTERN | SETTLING TIME |
|---|---|---|---|
| A | Fast Response | $r(t) = .5s(t) + .5s(t-.497T_0)$ | $.497T_0$ |
| B | Period-Averaged | $r(t) = \frac{\int_0^{.99T_0} s(t-q)\,dq}{.99T_0}$ | $.99T_0$ |
| C | One-Point Insensitive | $r(t) = .25s(t) + .5s(t-.468T_0) + .25s(t-.936T_0)$ | $.936T_0$ |
| D | Two-Point Insensitive | $r(t) = .25s(t) + .25s(t-.43T_0) + .25s(t-.485T_0) + .25s(t-.915T_0)$ | $.915T_0$ |
| | | $r(t) = .125s(t) + .125s(t-.33T_0) + .125s(t-.394T_0) + .125s(t-.482T_0) + .125s(t-.724T_0) + .125s(t-.812T_0) + .1255(t-.876T_0) + .125s(t-1.206T_0)$ | $1.206T_0$ |

This pattern will damp almost 60% of the reference rope length to better than a hundred to one reduction in swing and have an settling time of 1.206 $T_0$.

The filters of the present invention may also be used to dampen oscillation modes that are not directly related to a rope length. The oscillation frequency is identified and a pattern that will reduce or eliminate that frequency is applied. For instance, if a load is suspended by two ropes then it will have an additional twisting mode of oscillation that will depend on the mass, moment of inertia, length of each rope and position of each rope. From these parameters the frequency of the twisting oscillation can be determined.

A filter may then be constructed to filter out both swinging oscillation frequencies and twisting frequencies to dampen all load oscillations.

The present invention dampens load oscillations in a certain frequency range, by causing the speed of the carriage to have little or no frequency component in that frequency range. This will cause the derivative, (the acceleration of the carriage) to have little or no frequency component in the frequency range, thus causing load oscillations to be damped.

The method of the present invention may also be applied to acceleration and position signals as well as speed signals. Alternatively, an acceleration reference signal may be input into the damping filter 40. The output signal then represents an acceleration damping signal which may be used to determine the acceleration of the carriage's motor. The damping signal could also be obtained by feeding a position reference signal into the filter 40. The output signal then represents a position damping signal which positions the carriage. Since the resulting output position function has little or no frequency component in the frequency range, little or no frequency component will exist in its second derivative or acceleration.

Moreover, a torque reference signal could also be fed into the filter 40. The output signal then represents a torque damping signal which may control the torque of the carriage motor 28. In this case, the frequencies that the filter must eliminate are based on a reduced rope length rather than the actual rope length to compensate for the carriage oscillating along with the load. This moves the center of oscillation of the carriage-rope system to somewhere between the point of suspension and the load, rather than the point of suspension. The reduced rope length is computed by multiplying the actual rope length by $M_C/(M_C+M_L)$ where $M_C$ is the mass of the carriage and $M_L$ is the mass of the load.

Whether speed, acceleration, position, or torque is controlled with the damping signal, the resultant acceleration profile will be based on the pattern chosen for the damping.

As long as the traversing motion of the carriage 22 is controlled by the filter output of the present invention, damping will occur. Hence, any other type of enhancements to the damping system, such as positioning control or limiting the maximum acceleration of the carriage, or limiting the current provided by the variable speed drive, may be implemented by adjusting the input signal to the filter appropriately. The general method of implementing a limiting routine for any crane parameter such as torque, acceleration or motor current, is to examine the data already in the shifting array 54 and adjust the next data clocked into the array in order to produce the required limitation of the chosen parameter. As long as the damping signal, r(t), is affected by adjusting the data clocked into the array 54 alone, the damping effect of the filter 40 will continue unhindered.

Section 4: Adapting The Method To Respond To A Varying Rope Length Signal

Section 2 describes systems where rope length information is determined by preset constants. The systems do not receive any signal to indicate the actual and, possibly varying, length of the hoisting rope. In the above examples, data was clocked into a shifting array 54 at fixed rates and the coefficients of the linear combination forming the filter output are constant, thereby simplifying the calculations. To provide even better damping, the present method may be adapted to respond to a dynamically changing rope length signal by varying the rate, as a function of the measured rope length, at which the data is clocked into the shifting array 54. Specifically, the speed reference signal is clocked into the shifting array 54 at a rate proportional to $1/\sqrt{L}$ where L is the measured rope length. The coefficients of the linear combination forming the output remain fixed, thus keeping calculations simple.

Figure 15:
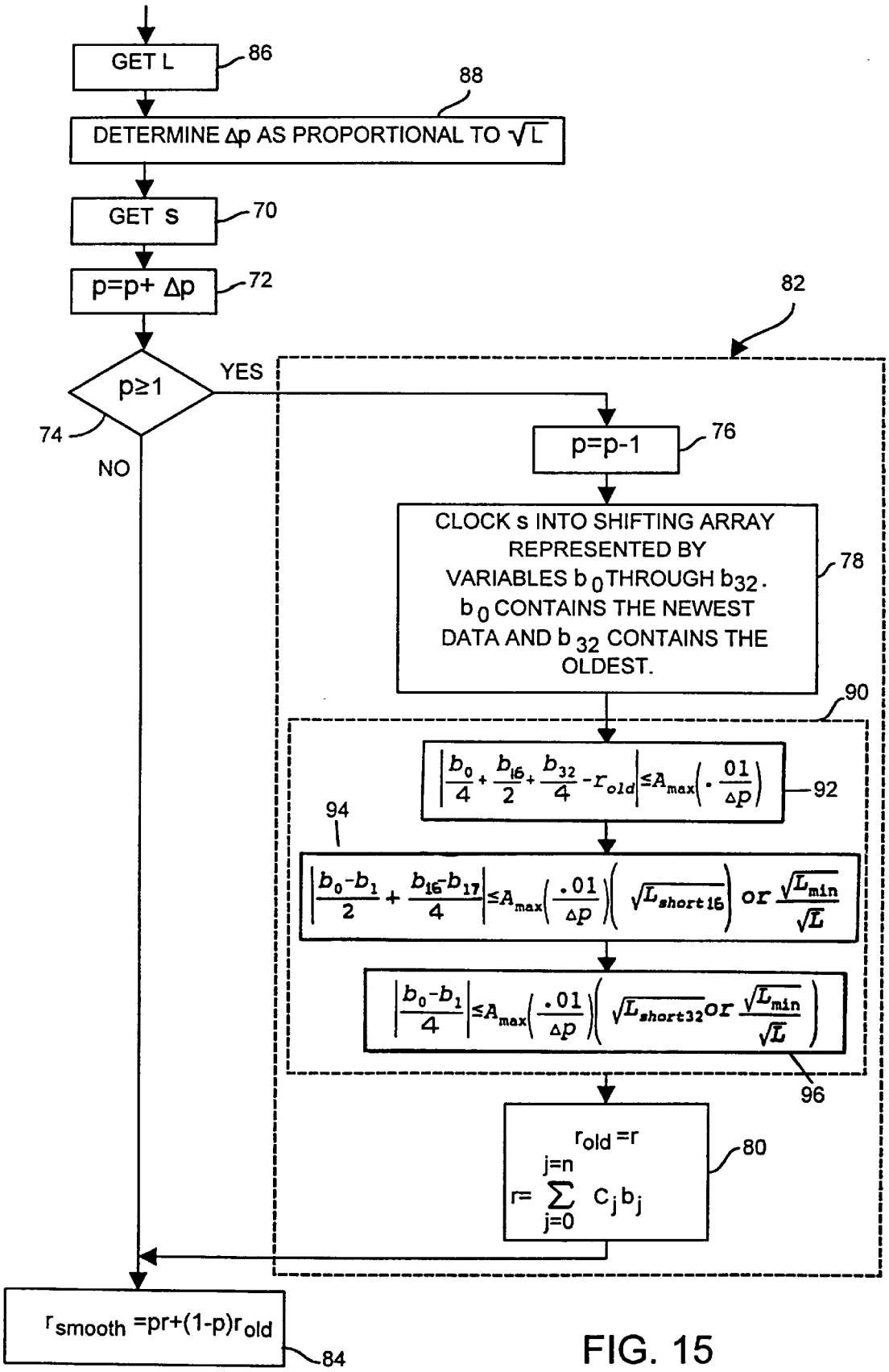
FIG. 15 is a flow diagram of a preferred embodiment of the method of the present invention adapted to respond to a varying rope length signal produced by a rope length sensor.

FIG. 15 is a flow diagram of a program segment embodying this technique. The program is similar to that described in FIG. 6 except for the inclusion of the initial steps 86 and 88, and an optional limitation step 90. The variable $\Delta p$ determines the rate at which loop 82 executes. The execution rate is proportional to the variable $\Delta p$. The program segment in FIG. 15 reads the rope length L from the rope length signal from the rope length sensor 45. $\Delta p$ is varied in proportion to $1/\sqrt{L}$ in step 88. Hence the loop 82 will execute at a rate proportional $1/\sqrt{L}$.

The program segment in FIG. 15 may be used to construct a damping filter that responds to a varying rope length signal using any desired pattern. First, for a given rope length $L_0$, a pattern is chosen to dampen swing within a desired range of rope lengths relative to $L_0$. Second, an appropriate constant $\Delta p_0$ is chosen so that if $\Delta p$ was set equal to $\Delta p_0$ then the loop 82 executes at a rate causing data to pass through the shifting array 54 in approximately the settling time of the pattern. Third, constant coefficients $C_0$ through $C_{32}$ are calculated from the pattern as shown in Section 3 for the case when $\Delta p=\Delta p_0$. Finally, $\Delta p$ in step 88 is set to be $(\Delta p_0)(\sqrt{L_0})/\sqrt{L}$. This will cause the desired range of rope lengths for which damping will occur to shift in a manner tracking the actual varying rope length L.

Explicit values to adapt FIG. 15 to a fast-response, a period-averaged, and a one-point insensitive version are as follows.

To adapt the program segment corresponding to FIG. 15 to a fast-response version of the invention, both $C_0$ and $C_{32}$ are set to ½ and all the other coefficients are set to zero. Also $\Delta p$ in step 88 is set as:

$$\Delta p = \frac{.64\sqrt{g}}{2\pi\sqrt{L}}.$$

To adapt the program segment into FIG. 15 to the period-averaged version, the coefficients $C_0$ through $C_{32}$ are set to 1/33. $\Delta p$ is set in block 88 as $$\Delta p = \frac{.33\sqrt{g}}{2\pi\sqrt{L}}.$$

To adapt the program segment in FIG. 15 to the one-point insensitive version, the coefficients $C_0$ and $C_{32}$ are set to ¼, $C_{17}$ is set to ½ and all other coefficients are set to zero. Also $\Delta p$ in block 78 is set as $$\Delta p = \frac{.32\sqrt{g}}{2\pi\sqrt{L}}.$$

As noted in the previous section, various operational factors such as the maximum acceleration of the carriage, the motor current, or the torque may be limited by adjusting the input signal to the filter appropriately. An example of this limitation specific to the one point insensitive method may be seen in an optional step 90 which implements an acceleration limiting routine. The step 90 consists of three acceleration limiting substeps 92, 94 and 96 which each evaluate different performance criteria. The substeps 92, 94 and 96 may be appropriately altered when used with other patterns such as the period-averaged or fast-response patterns. The acceleration limiting substeps 92, 94 and 96 insure that the acceleration of the carriage 22 remains below a preset level, $A_{max}$. A maximum acceleration threshold may be required to limit shock on the load 32 or to keep certain crane parameters, such as the motor current within a safety range. In step 90, the data in $b_0$, the most recent value clocked into shifting array 54 is compared with three different criteria in substeps 92, 94 and 96. If the most recent value clocked does not exceed any of the criteria set in the substeps 92, 94 and 96, its value is not modified. If the most recent value clocked exceeds one of the acceleration criteria in substeps 92, 94 and 96, the value is set to the closest value that does not exceed any of the criteria.

The first criteria in substep 92 insures that the acceleration rate at the present moment does not exceed a preset acceleration rate, $A_{max}$. The second criteria in substep 94 insures that the carriage acceleration at a time 16 clockings in the future (i.e. the next time the data presently clocked in has an effect on the damping signal) will not exceed $A_{max}$. This calculation assumes that the value clocked into $b_0$ will be held constant for the next 16 clockings. The final criteria in substep 96 insures that the carriage acceleration 32 clockings in the future will not exceed $A_{max}$. This calculation assumes that the value clocked into $b_0$ will be held constant for the next 32 array clockings.

Each of the criteria in substeps 92, 94, and 96, the value represent the difference of two consecutive damping signal values. For the criteria in substep 92 the absolute value contains the newest value of the damping signal as a function of the difference between $b_0$ and the previous value of the damping signal, $r_{old}$. Similarly, the criteria of the substep 94 determines the difference of the damping signal values 16 and 15 clockings in the future. The absolute value of the difference of the damping signal values 32 and 31 clockings in the future are determined in the criteria for substep 96.

$A_{max}$ is the maximum predetermined acceleration rate and $0.01/\Delta p$ is the time interval between clockings. The right side of the criteria in substep 94 expresses an allowed change in the damping signal 16 clockings in the future while taking into account the possibility the rope length shortens during this time. The worst case shortest possible rope length 16 clockings in the future is estimated to be $L-(0.16/\Delta p)\ (dL/dt)_{max}$ and denoted as $L_{short16}$ or a predetermined value $L_{min}$ representing a physical lower limit on rope length, whichever is greater. The term, $(dL/dt)_{max}$ is a preset maximum rate of change of the rope length. The possibility of the hoisting rope 30 becoming shorter 16 clockings in the future is considered by including the square root of the shortest possible rope length 16 clockings in the future divided by the square root of the present rope length.

The right side of the criteria in substep 96 is similar to that of substep 96 except that it uses an estimated value for the shortest possible rope length 32 clockings in the future. $L_{short16}$ is defined as $L-(0.32/\Delta p)\ (dL/dt)_{max}$.

There are other alternatives to implement an acceleration limiting routine. For example, only the criteria in substep 92 need be used to achieve acceleration limitation. The acceleration limit $A_{max}$ may be calculated to limit motor current if desired. Similarly torque may also be limited by using a torque feedback signal to adjust $A_{max}$. If no rope length signal is present, the right side of each criteria 92, 94, 96 may be simply set to $A_{max}(0.01/\Delta p)$. The parameter limitation may be performed for any of the above mentioned load oscillation control methods. For example, in the fast response embodiment of the present invention substeps 94 would not be required. The criteria in substep 92 would be replaced by $$\left|\frac{b_0}{2}+\frac{b_{32}}{2}-r_{old}\right| \le A_{\max}\left(\cdot\ \frac{01}{\Delta p}\right)$$

and the criteria in substep 96 is replaced with $$\left|\frac{b_0-b_1}{2}\right| \le A_{\max}\left(\frac{.01}{\Delta p}\right)\left(\frac{\sqrt{L_{short32}}\ \text{ or }\ \sqrt{L_{\min}}}{\sqrt{L}}\right)$$

If desired, data may still be clocked into the array 54 at a fixed rate and the linear combination coefficients varied as a function of the hoisting rope length to provide a damping signal. By varying the coefficients, fixed rate clocking provides a damping signal similar to that provided by changing the clocking rate. Defining a normalized time coordinate $\phi$ by $\dot{\phi}=\sqrt{g}/\sqrt{L}$. The variable $\phi$ is defined so that it will track the pendulum motion of the load by increasing by $2\pi$ for every period of the pendulum that passes, even if the rope length changes. The method of changing the clocking rate produces a constant interval of normalized time, instead of real time, between the elements of the array. Clocking the speed reference signal into a first shifting array at a fixed rate and clocking a term proportional to $1/\sqrt{L}$, (or some coded form of this information) into a second shifting array at the same fixed rate allows data in the second array to be used as a record of the difference in normalized time between elements in the first array. Data in the second array is used to calculate the damping intervals with respect to normalized time, and the measure by which the damping function part of the pattern will act on the speed reference signal. Ultimately, the coefficients in the linear combination producing the damping signal depend on data in the second array.

Figure 16:
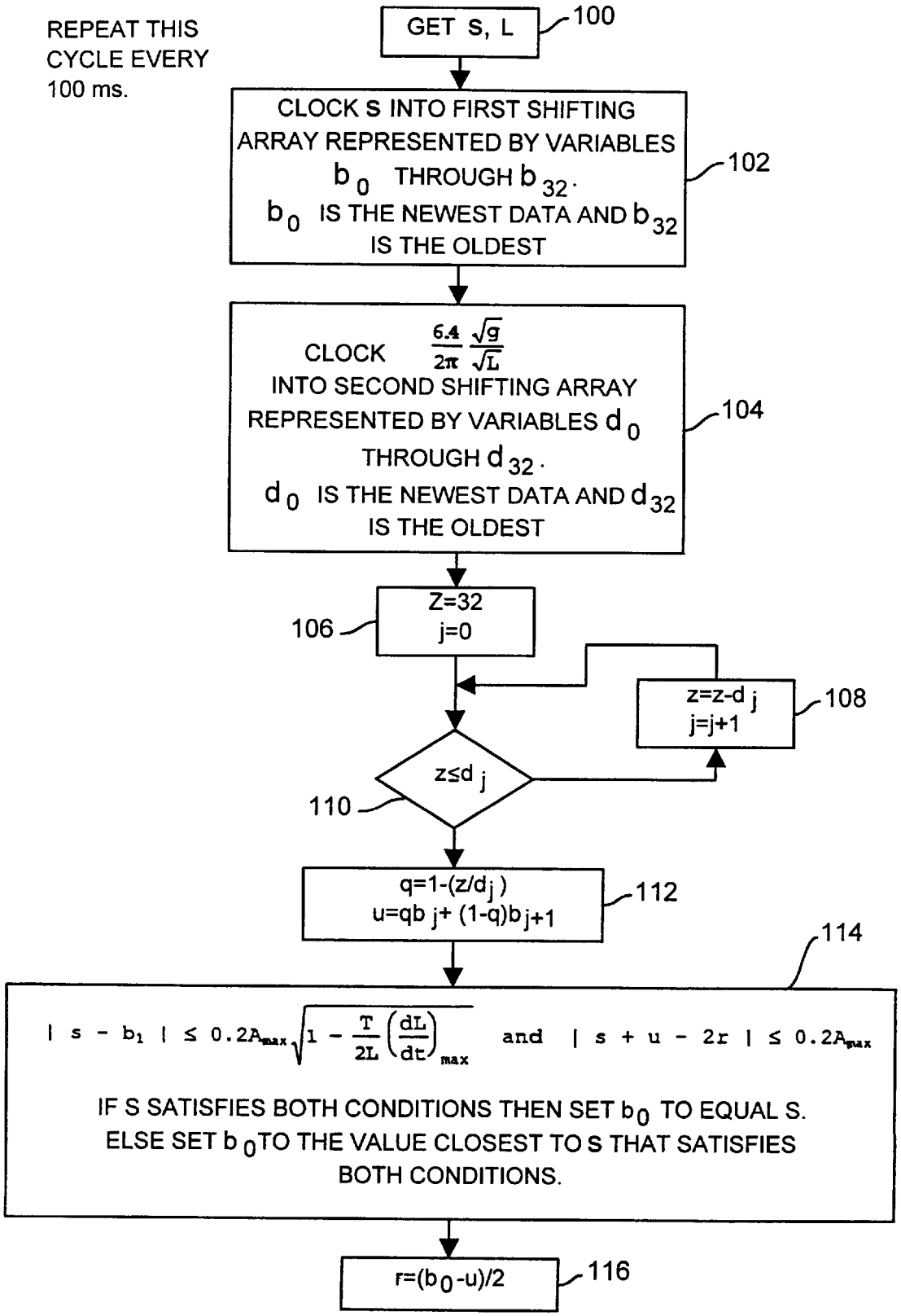
FIG. 16 is a flow diagram of an alternate embodiment of the fast-response version method of the present invention.

FIG. 16 is a flow diagram embodying this technique for a fast-response version of the invention. The second shifting array tracks the amount of normalized time that has elapsed between clockings and is used to determine the index of the data in the first array clocked one-half period in the past, with respect to normalized time. This segment is intended to be execute at constant intervals of 100 ms.

The program segment in FIG. 16 starts by reading the rope's length L and the speed reference signal s(t) in step 100. Next, s(t) is clocked into the first shifting array in step 102, represented by the memory locations $b_0$ through $b_{32}$ where $b_0$ is the newest value and $b_{32}$, is the oldest. In step 104, a second signal is clocked into a second shifting array represented by the memory locations $d_0$ through $d_{32}$, where do is the newest value and $d_{32}$ is the oldest. This second signal is proportional to the inverse of the square root of L and it represents that fraction of the period of the pendulum motion that has elapsed since the previous clocking. The constant of proportionality is chosen so that the number 32 would represent one-half period. Step 106 sets z to 32; and step 108 increments j and substitutes the value in memory (location $d_j$). Step 110 checks if z is less than the current memory value and determines parameters j and z which are used to locate the value within the first array that represents one-half period in the past (according to normalized time). The loop consisting of steps 108 and 110 counts down the normalized time stored in the second array while it increments j. The value q contains the fraction that is left over and is used as the weighing with which to interpolate between $b_j$ and $b_{j+1}$ to obtain the value of s(t) one-half period in the past.

In step 112, the actual interpolation is performed and the value of the array at one-half period in the past is stored in u. The segment finishes in step 116 by computing r as the average of $b_0$ and u.

Step 114 contains an acceleration limiting step. The value in $b_0$ is adjusted to keep the acceleration of the motor below a preset limit $A_{max}$. Here L is the rope length and T is the associated period.

The above described embodiments are merely illustrative of the principles of this invention. Other arrangements and advantages may be devised by those skilled in the art without departing from the spirit and scope of the invention. Accordingly, the invention should be deemed not to be limited to the above detailed description but only by the spirit and scope of the claims which follow.

What is claimed is:

1. A method of damping load oscillations during a traversing run of a load suspended at a height by a hoisting rope from a movable carriage on a track, the carriage powered by a motor controlled by a motor drive, the method being insensitive to changes in load height and comprising the steps of:

(a) generating a motion reference signal, s(t), representative of a desired motion of the carriage;

(b) constructing a damping signal from said motion reference signal substantially of the form:

$$(¼)+(t)+(½)+(t-T/2)+(¼)+(t-T)$$

where T is the period of oscillation of the load for load heights near the center of the desired range of load heights to be damped; and (c) coupling said damping signal to said motor drive to control carriage motion so that said damping signal causes load oscillations to be damped.

2. The damping method of claim 1 additionally comprising the step of varying the period T in the formula for the damping signal in response to changes in load height.

3. The damping method of claim 2 wherein said hoisting rope has a length, additionally comprising the step of detecting a change in said load height using a rope length sensor.

4. A method of damping load oscillations during a traversing run of a load suspended at a load height by a hoisting rope from a movable carriage on a track, the carriage powered by a motor controlled by a motor drive, the method being insensitive to changes in load height and comprising the steps of:

(a) generating a motion reference signal representative of a desired motion of the carriage;

(b) filtering said motion reference signal with a finite impulse response filter to form a damping signal, said filter having a frequency response that is sufficiently small over a continuous range of frequencies to produce said insensitivity to changes in load height for load heights having oscillation frequencies within said continuous range; and (c) coupling said damping signal to said motor drive to control carriage motion so that said damping signal causes load oscillations to be damped.

5. The damping method of claim 4 additionally comprising the step of varying said filter in response to changes in load height.

6. The damping method of claim 5 wherein said hoisting rope has a length, additionally comprising the step of detecting a change in said load height using a rope length sensor.

7. A method of damping load oscillations during a traversing run of a load suspended at a height by a hoisting rope from a movable carriage on a track, the carriage powered by a motor controlled by a motor drive, the method being insensitive to changes in load height and comprising the steps of:

(a) generating a motion reference signal representative of a desired motion of the carriage;

(b) filtering said motion reference signal with a finite impulse response filter to form a damping signal, said filter having a normalized frequency response of below 0.08 for a continuous range of angular frequencies, the normalized frequency response of said filter for an arbitrary angular frequency ω being defined as the absolute value of $f(e^{i\omega t})$ divided by the absolute value of f(1), where $f(e^{i\omega t})$ is the output of the filter acting on an input waveform $e^{i\omega t}$ and where f(1) is the output of the filter acting on the unit function, said continuous range of angular frequencies containing an angular frequency $\omega_0$ for which said filter has an impulse response duration that is less than 3.5 times the period of oscillation associated with the angular frequency $\omega_0$, said continuous range of angular frequencies containing the angular frequency 1.24 $\omega_0$; and (c) coupling said damping signal to said motor drive to control carriage motion so that said damping signal causes load oscillations to be damped for load heights having angular frequencies of oscillation within said continuous range of angular frequencies.

8. The damping method of claim 7 additionally comprising the step of varying said filter in response to changes in load height.

9. The damping method of claim 8 wherein said hoisting rope has a length, additionally comprising the step of detecting a change in said load height using a rope length sensor.

10. A method of damping load oscillations during a traversing run of a load suspended at a height by a hoisting rope from a movable carriage on a track, the carriage powered by a motor controlled by a motor drive, the method being insensitive to changes in load height and comprising the steps of:

(a) determining a damping function, said damping function having a frequency content sufficiently small over a continuous range of frequencies to produce said insensitivity to changes in load height for load heights having oscillation frequencies within said continuous range;

(b) generating a damping signal utilizing said damping function; and (c) coupling said damping signal to said motor drive to control carriage motion so that said damping signal causes load oscillations to be damped.

11. The damping method of claim 10 additionally comprising the step of varying said damping function in response to changes in load height.

12. The damping method of claim 11 wherein said hoisting rope has a length, additionally comprising the step of detecting a change in said load height using a rope length sensor.

13. A method of damping load oscillations during a traversing run of a load suspended at a height by a hoisting rope from a movable carriage on a track, the carriage powered by a motor controlled by a motor drive, the method being insensitive to changes in load height and comprising the steps of:

(a) determining a damping function W(t) having a normalized angular frequency content of below 0.08 for a continuous range of angular frequencies, the normalized angular frequency content of said damping function for an arbitrary angular frequency ω being defined as the absolute value of $\int_{-\infty}^{\infty} e^{-i\omega t} W(t)dt$ divided by the absolute value of $\int_{-\infty}^{\infty} W(t)dt$, said continuous range of angular frequencies containing an angular frequency $\omega_0$ for which said damping function has a time duration that is less than 3.5 times the period of oscillation associated with the angular frequency $\omega_0$, said continuous range of angular frequencies containing the angular frequency 1.24 $\omega_0$;

(b) generating a damping signal utilizing said damping function; and (c) coupling said damping signal to said motor drive to control carriage motion so that said damping signal causes load oscillations to be damped for load heights having angular frequencies of oscillation within said continuous range of angular frequencies.

14. The damping method of claim 13 additionally comprising the step of varying said damping function in response to changes in load height.

15. The damping method of claim 14 wherein said hoisting rope has a length, additionally comprising the step of detecting a change in said load height using a rope length sensor.

16. A method of damping load oscillations during a traversing run of a load suspended at a height by a hoisting rope from a movable carriage on a track, the carriage powered by a motor controlled by a motor drive, the method being insensitive to changes in load height and comprising the steps of:

(a) generating a damping signal based on a damping pattern, said damping pattern comprising a plurality of damping constants $N_0$ through $N_n$ and corresponding time intervals $\tau_0$ through $\tau_n$, said damping pattern having a normalized angular frequency content of below 0.08 for a continuous range of angular frequencies, the normalized angular frequency content of said damping pattern for an arbitrary angular frequency ω being defined as the absolute value of $\Sigma N_j e^{-i\omega\tau}$ for j from 0 to n divided by the absolute value of $\Sigma N_j$ for j from 0 to n, said continuous range of angular frequencies containing an angular frequency $\omega_0$ for which said damping pattern has a settling time that is less than 3.5 times the period of oscillation associated with the angular frequency $\omega_0$, said continuous range of angular frequencies containing the angular frequency 1.24 $\omega_0$; and (b) coupling said damping signal to said motor drive to control carriage motion so that said damping signal causes load oscillations to be damped for load heights having angular frequencies of oscillation within said continuous range of angular frequencies.

17. The damping method of claim 16 additionally comprising the step of varying said damping pattern in response to changes in load height.

18. The damping method of claim 17 wherein said hoisting rope has a length, additionally comprising the step of detecting a change in said load height using a rope length sensor.

19. A load oscillation dampener that damps load oscillations during a traversing run of a load suspended at a height by a hoisting rope from a movable carriage on a track, the carriage powered by a motor controlled by a motor drive, the dampener being insensitive to changes in load height and comprising:

(a) a signal generator that generates a motion reference signal representing desired motion of the carriage in response to operator input;

(b) a finite impulse response filter that filters said motion reference signal and produces a damping signal, said filter having a normalized frequency response of below 0.08 for a continuous range of angular frequencies, the normalized frequency response of said filter for an arbitrary angular frequency ω being defined as the absolute value of $f(e^{i\omega t})$ divided by the absolute value of f(1), where $f(e^{i\omega t})$ is the output of the filter acting on an input waveform $e^{i\omega t}$ and where f(1) is the output of the filter acting on the unit function, said continuous range of angular frequencies containing an angular frequency $\omega_0$ for which said filter has an impulse response duration that is less than 3.5 times the period of oscillation associated with the angular frequency $\omega_0$, said continuous range of angular frequencies containing the angular frequency 1.24 $\omega_0$; and (c) a motor drive coupled to said finite impulse response filter to cause carriage motion in response to said damping signal so that load oscillations are damped for load heights having angular frequencies of oscillation within said continuous range of angular frequencies.

20. The dampener of claim 19 wherein said finite impulse response filter is varied in response to changes in load height.

21. A load oscillation dampener that damps load oscillations during a traversing run of a load suspended at a height by a hoisting rope from a movable carriage on a track, the carriage powered by a motor controlled by a motor drive, the dampener being insensitive to changes in load height and comprising:

(a) a signal generator that generates a damping signal in response to operator input and that utilizes a damping function W(t) having a normalized angular frequency content of below 0.08 for a continuous range of angular frequencies, the normalized angular frequency content of said damping function for an arbitrary angular frequency ω being defined as the absolute value of $\int_{-\infty}^{\infty} e^{-i\omega t} W(t)dt$ divided by the absolute value of $\int_{-\infty}^{\infty} W(t)dt$, said continuous range of angular frequencies containing an angular frequency $\omega_0$ for which said damping function has a time duration that is less than 3.5 times the period of oscillation associated with the angular frequency $\omega_0$, said continuous range of angular frequencies containing the angular frequency 1.24 $\omega_0$; and (b) a motor drive coupled to said signal generator to cause carriage motion in response to said damping signal so that load oscillations are damped for load heights having angular frequencies of oscillation within said continuous range of angular frequencies.

22. The dampener of claim 21 wherein said signal generator is varied in response to changes in load height.

23. A load oscillation dampener that damps load oscillations during a traversing run of a load suspended at a height by a hoisting rope from a movable carriage on a track, the carriage powered by a motor controlled by a motor drive, the dampener being insensitive to changes in load height and comprising:

(a) a signal generator that generates a damping signal in response to operator input and based on a damping pattern that comprises a plurality of damping constants $N_0$ through $N_n$ and corresponding time intervals $\tau_0$ through $\tau_n$, said damping pattern having a normalized angular frequency content of below 0.08 for a continuous range of angular frequencies, the normalized angular frequency content of said damping pattern for an arbitrary angular frequency ω being defined as the absolute value of $\Sigma N_j e^{-i\omega\tau}$ for j from 0 to n divided by the absolute value of $\Sigma N_j$ for j from 0 to n, said continuous range of angular frequencies containing an angular frequency $\omega_0$ for which said damping pattern has a settling time that is less than 3.5 times the period of oscillation associated with the angular frequency $\omega_0$, said continuous range of angular frequencies containing the angular frequency 1.24 $\omega_0$; and (b) a motor drive coupled to said signal generator that causes carriage motion in response to said damping signal so that load oscillations are damped for load heights having angular frequencies of oscillation within said continuous range of angular frequencies.

24. The dampener of claim 23 wherein said signal generator is varied in response to changes in load height.

* * * * *